United States Patent [19]

Dallen et al.

[11] 4,162,656

[45] Jul. 31, 1979

[54] WASTE DISPOSAL BY INCINERATION

[75] Inventors: John A. Dallen, Port Clinton, Ohio; Harry W. Green, Sarasota, Fla.

[73] Assignee: The Standard Products Company, Cleveland, Ohio

[21] Appl. No.: 791,496

[22] Filed: Apr. 27, 1977

Related U.S. Application Data

[62] Division of Ser. No. 738,531, Nov. 3, 1976, abandoned.

[51] Int. Cl.[2] ..... F23G 5/00

[52] U.S. Cl. ..... 110/221; 4/111.1; 4/111.2; 4/111.4; 210/63 R; 210/69; 210/71

[58] Field of Search ..... 210/63 R, 69, 71, 143, 210/149, 152; 4/10, 131; 110/7 B, 8 P, 9 R, 72 B; 134/22 C, 101, 103, 169 C

[56] References Cited

U.S. PATENT DOCUMENTS

| | | | |
|---|---|---|---|
| 2,367,165 | 1/1945 | Astradsson | 110/72 B |
| 2,619,974 | 12/1952 | Daley et al. | 134/103 |
| 2,632,719 | 3/1953 | Tankersley | 134/22 C |
| 2,995,097 | 8/1961 | Kruckeberg | 4/131 |
| 3,703,732 | 11/1972 | Green | 4/131 |
| 3,706,662 | 12/1972 | Wellford | 210/63 R |
| 3,741,134 | 6/1973 | Roberts | 110/7 B |
| 3,816,857 | 6/1974 | West | 4/131 |
| 3,856,672 | 12/1974 | Boswinkle | 210/63 R |
| 3,925,827 | 12/1975 | Wagenhals | 4/111.2 |
| 3,951,803 | 4/1976 | Siegel | 210/149 |
| 3,974,075 | 8/1976 | Saigh et al. | 210/152 |
| 3,995,568 | 12/1976 | Dvirka | 110/72 B |

*Primary Examiner*—Charles N. Hart
*Assistant Examiner*—Ernest G. Therkorn
*Attorney, Agent, or Firm*—Harness, Dickey & Pierce

[57] ABSTRACT

Disclosed is a portable waste disposal system that is designed primarily for use in marine craft, mobile homes, campers or the like. The system comprises a macerator unit for converting excrement to a liquified effluent, and an incinerator unit for incinerating the effluent. The macerator unit comprises a holding tank which receives the waste material from a toilet.

The incineration unit comprises a combustion chamber. A burner is provided which introduces a high temperature flame into the combustion chamber to incinerate the effluent.

The fuel for the burner is regulated by a pair of fuel valves, one of which is cycled to maintain the temperature of the exhaust gases from the combustion chamber within predetermined limits.

11 Claims, 27 Drawing Figures

Gravity Flow Ambient Air

Incoming Combustion & Outgoing Secondary Cooling Air

Primary Cooling Air

Combustion Exhaust Gasses

Power Buss Control CKT.

LCP & LAM Power Switch

LMP-PFV & Pump-LFP Power Sw.

Link Blow Ckt.

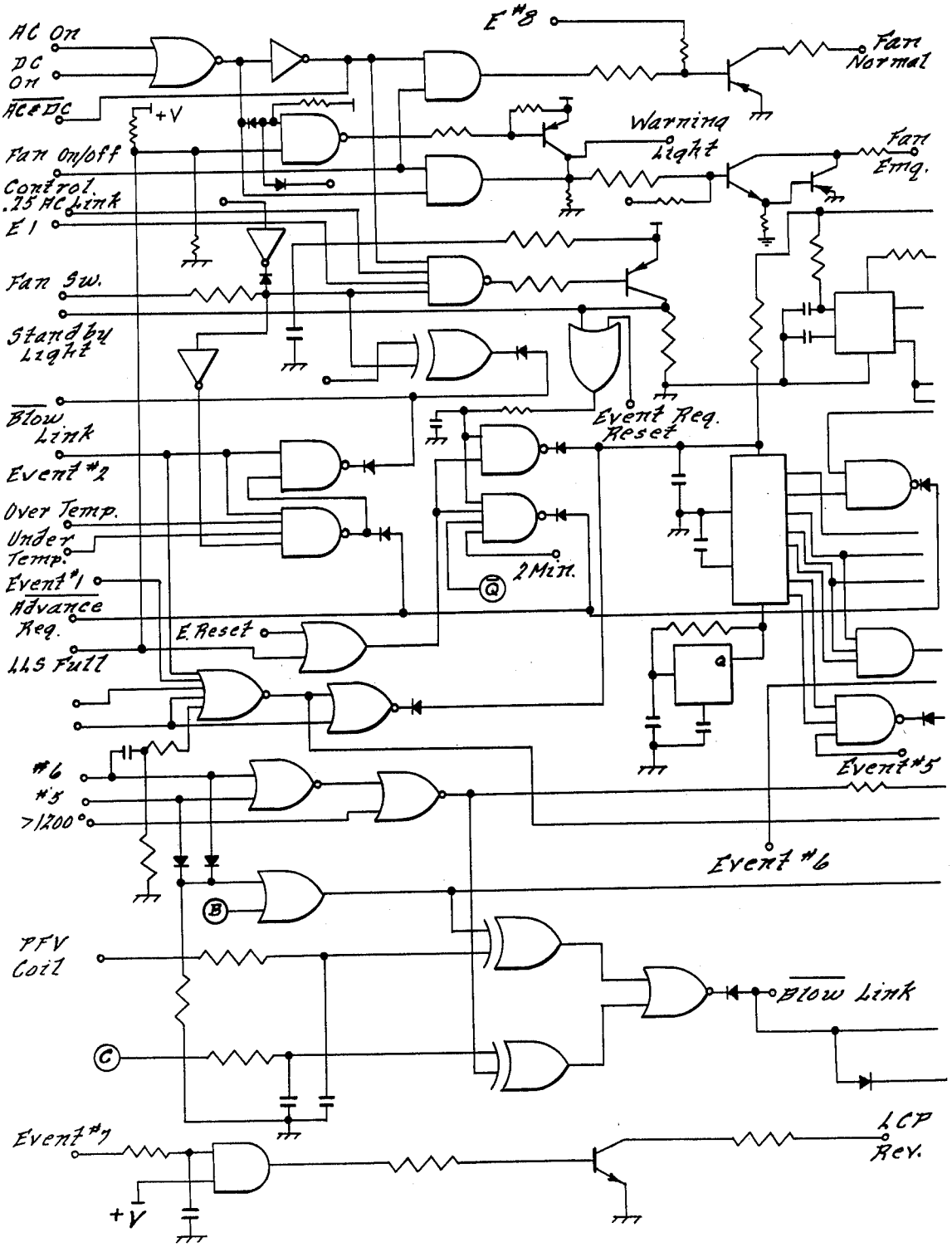
FIG. 26A. Event Control

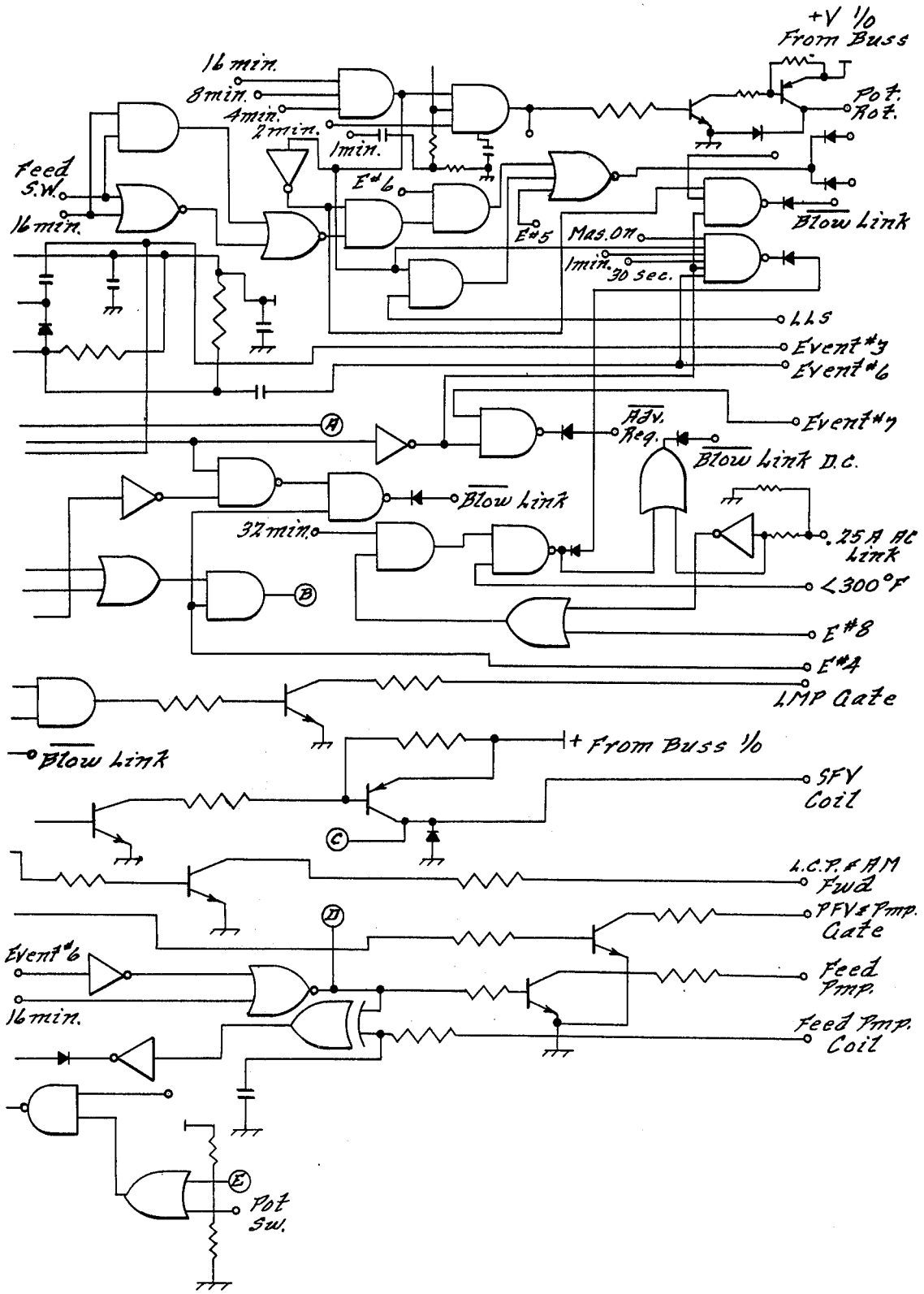
Logic & Timing Ckt. Fig. 26B.

WASTE DISPOSAL BY INCINERATION

This is a division of copending application Ser. No. 738,531, filed Nov. 3, 1976 now abandoned.

BACKGROUND AND SUMMARY OF THE INVENTION

The present invention relates to a method of using portable waste disposal system that is adapted primarily for use in marine craft, mobile homes, trailers and the like.

Due to increasingly strict federal and state environmental regulations, it has become necessary to avoid the discharge of untreated sewage from boats and other vehicles, as well as the indiscriminate disposal of sewage in any environment, even remote and rural areas. Present day air pollution standards have also made the discharge of noxious odors into the atmosphere illegal in many areas. In addition, a general increased concern over the environment has made the disposal of raw sewage and the discharge of offensive odors extremely undesirable.

Many procedures have been proposed for the disposal of sewage under such difficult conditions as exist where the sanitary facilities are carried by vehicles. The use of heat to vaporize the liquid effluent from the source of sewage, or from an intermediate septic tank, has been proposed. In some instances, waste heat from an internal combustion engine or other heat source carried by the vehicle has been employed. Boilers and vaporization chambers have also been utilized into which the sewage or liquid effluent is directly introduced. However, with such systems, the minerals and organic solids in the effluent eventually form a caked deposit on the internal walls of the boilers or vaporization chambers, thus acting as a heat insulator, and greatly reducing the volume of the boiler and the efficiency of the heat transfer to the boiler walls. Consequently, the boiler is no longer capable of operating at optimum efficiency, and may also be incapable of vaporizing waste material at the required rate. The reduced operating temperature can also result in the creation of noxious odors in greater quantity.

A typical waste disposal system currently used in many marine craft simply comprises an incinerator unit located directly beneath the toilet for receiving the waste material. The system is operated simply by closing a hatch located at the top of the unit and activating a burner which incinerates the excrement for a predetermined period of time. After several operations of the system, the incinerator must be cleaned through the same hatch; which can be a very unpleasant and tedious task.

The present invention seeks to overcome the disadvantages of these prior art systems by providing a portable waste disposal system that operates completely automatically, generates no offensive odors, requires infrequent cleaning and is easy to clean. In addition, the present system is adapted to incinerate the waste material as completely as possible so that a minimum amount of solid waste material is left unconverted. In particular, the present invention is adapted to produce only approximately 15 grams of solid matter for every gallon of excrement disposed. Consequently, on the average, clean out of the system is required only every 14 days when continuously in use. In addition, the system can dispose of approximately one gallon of excrement every hour, which is sufficient to accommodate the excrement of as many as 8 adults on a continuous basis when a flush efficient marine type toilet is used.

In general, the present method uses a system that comprises a macerator unit for converting the excrement to a liquified effluent, and an incinerator unit for incinerating the liquified effluent. The macerator unit comprises a tank that is divided into a holding compartment and a feed compartment. Excrement is supplied through a waste inlet into the holding compartment from where it is macerated and provided to the feed compartment. A liquid circulation pump draws the effluent from the feed compartment and pumps the effluent to the incinerator unit, which may be located at a point on the craft or vehicle quite remote from the macerator unit.

The incinerator unit essentially comprises a combustion chamber having a crucible disposed therein for receiving the effluent. Controlled amounts of effluent are supplied to the combustion chamber by a feed pump which draws effluent from the circulation line supplied by the liquid circulation pump from the macerator unit. A high temperature burner is mounted on the top of the combustion chamber that is adapted to generate a downwardly directed flame which engulfs the entire combustion chamber. The fuel for the burner is provided by a fuel pump and is regulated by a pair of fuel valves. The primary fuel valve is adapted to provide a minimum amount of fuel to the burner, and the secondary fuel valve is cycled between its open and closed position in accordance with the temperature of the exhaust gases from the combustion chamber. In this manner, the temperature of the incineration process can be controlled within preselected temperature parameters to optimize the incineration process and prevent the production of offensive odors. The effluent within the combustion chamber is incinerated until all of the liquid has been vaporized and the remaining solid matter has been reduced to a fine ash. The latter part of the incineration cycle, or burn-out cycle, is conducted with a reduced fuel-to-air mixture so that the remaining solid waste matter is completely oxidized. In this manner, only a minimum amount of solid waste matter remains after the completed incineration cycle. In addition, by completely oxidizing the solid matter to a fine ash, the crucible can be readily emptied of the remaining ash material simply by rotating the crucible to dump the material to the floor of the chamber. From there, the ash material is easily removed from the unit via a convenient ash removal duct located at the rear of the unit. In this manner, the continuous build-up or caking of the effluent within the incinerator unit is avoided.

The incinerator unit is cooled by a pair of forced draft fans which circulate ambient air through a pair of cooling chambers which completely surround the combustion chamber. The air from the cooling chambers is then mixed with the exhaust gases from the combustion chamber to cool the exhaust gases before being expelled from the incinerator unit. In addition to providing cooling for the combustion chamber, the fans also serve other cooling functions. In particular, the primary cooling fan draws ambient air through the control compartment to dissipate the heat from the electronic control unit, and also directs cooling air along the shaft connecting the pot rotator motor to the crucible within the combustion chamber. In this manner, the motor is protected from the intense heat of the combustion chamber which would otherwise be transmitted along the shaft and cause the motor to overheat.

Similarly, the combustion fan, in addition to drawing ambient air around the combustion chamber, provides the air supply for the burner, and also supplies cooling air along the effluent feed line into the combustion chamber to cool the feed line and prevent the heat from the combustion chamber from causing the effluent to cake within the feed line.

The entire waste disposal system is operated and controlled by a solid state electronic control unit comprising a d.c. battery powered logic and timing unit and a high current, high voltage transistor switching panel supplying d.c. generator or rectified a.c. power to the various mechanical components. In addition to controlling the entire sequence of events which occur during the system's operation, the control circuit continuously performs various safety checks to insure that the system is operating within specified critical parameters. If at any time a condition arises which does not fit within these parameters, the control circuit automatically enters an emergency shutdown sub-routine which effectively deactivates the entire system, except for the fans, which continue to operate until the system has cooled to a safe level.

BRIEF DESCRIPTION OF THE DRAWINGS

Other objects and advantages of the present invention will become apparent from a reading of the following detailed description of the preferred embodiment which makes reference to the following set of drawings in which:

FIGS. 18 through 26*a* and 26*b* are circuit diagrams of the electronic control unit of the present invention;

DETAILED DESCRIPTION OF THE PREFERRED EMBODIMENT

Figure 1:
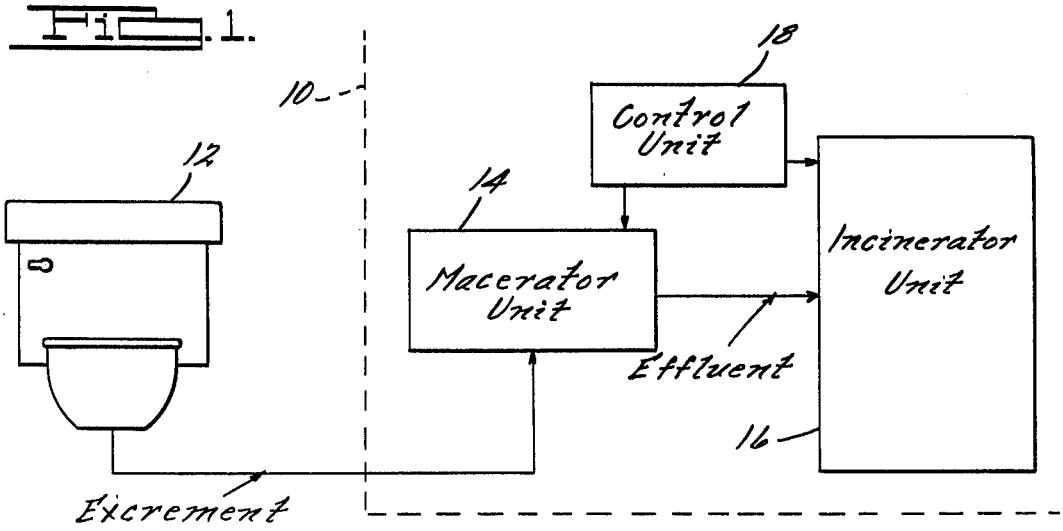
FIG. 1 is a block diagram of a typical application of the present invention.

Referring to FIG. 1, a general block diagram illustrating a typical application of the present waste disposal system 10 is shown. The complete waste disposal system comprises three basic units, the macerator unit 14, the incinerator unit 16, and the electronic control unit 18. Each of the three units may be located separate from the other two units, although in the preferred embodiment the control unit 18 is located within the same enclosure that houses the incinerator unit 16.

Generally speaking, the macerator unit 14 is adapted to receive excrement directly from a toilet 12 which may be located on a marine craft, mobile home, camper trailer, etc. The macerator unit 14 macerates or liquifies the excrement into an effluent which is provided to the incinerator unit 16. The incinerator unit 16 is adapted to dispose of the effluent by incineration at temperatures preferably in excess of 1000° F. When incinerated at these elevated temperatures, the majority of the effluent evaporates in the form of water vapor and the remaining solid waste matter is reduced to a fine ash.

Both the macerator unit 14 and incinerator unit 16 are operated under the control of a completely solid state electronic control unit 18. The control unit 18 essentially controls and monitors the various sequence of events which takes place during the system's operation. In addition, the control unit 18 continuously performs various safety checks to insure that the system is operating within certain specified critical parameters.

Practically speaking, the present waste disposal system 10 has the capacity to dispose of excrement at a rate of approximately one gallon per hour. Correspondingly, the present system can accommodate the excrement of eight adult individuals on a continuous basis when a flush efficient marine type toilet is used. In addition, the system produces only approximately 15 grams of solid waste matter for every gallon of excrement disposed. Accordingly, since the disposal of excrement is so complete, the present system 10 eliminates the necessity of frequent cleaning.

Figure 2:
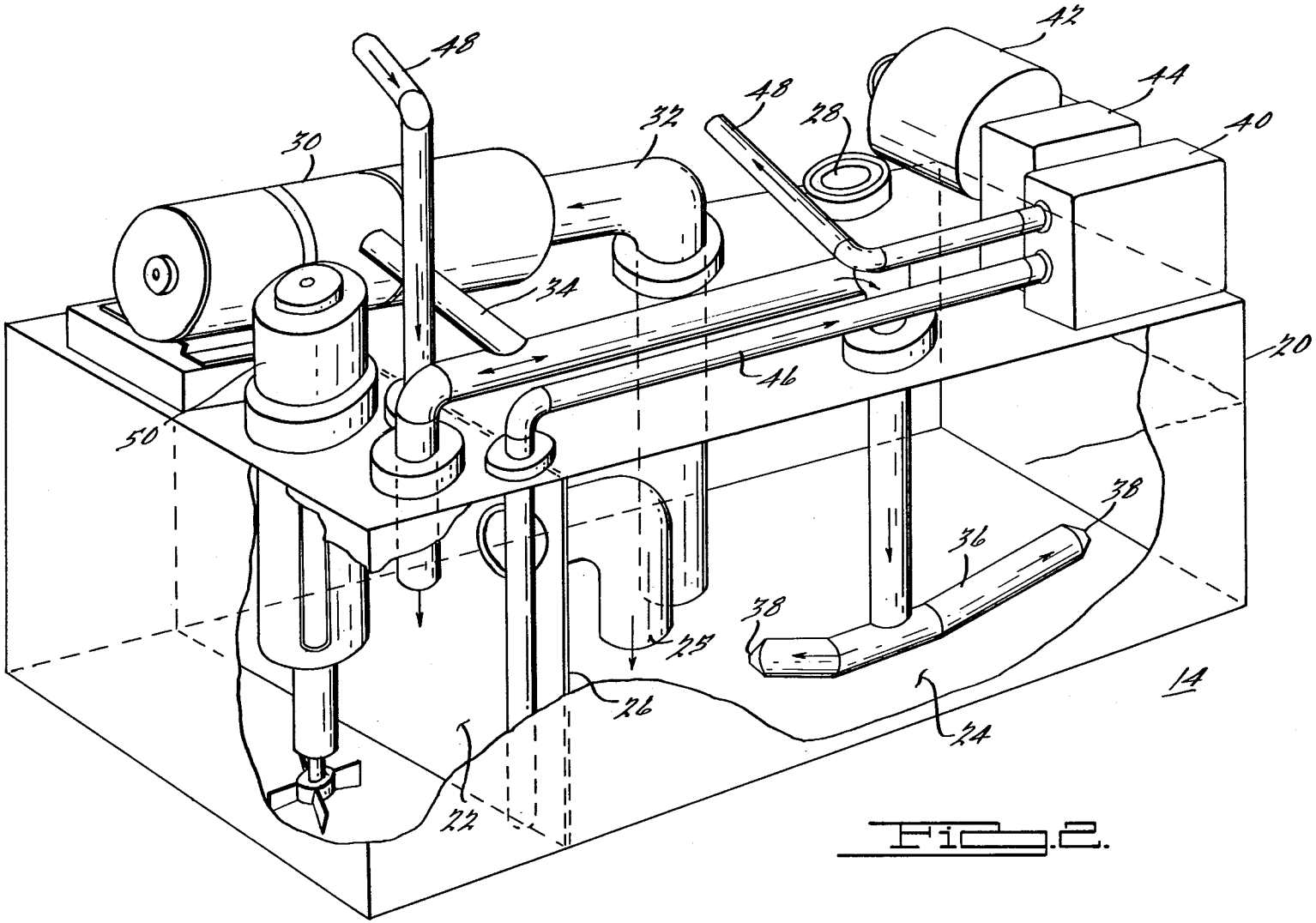
FIG. 2 is a plan view of the macerator unit of the present invention.

Looking to FIG. 2, a plan view of the macerator unit 14 according to the present invention is shown. The macerator unit 14 comprises a rectangular shaped tank 20 having a feed compartment 22 and a holding compartment 24 separated by a partition 26 disposed within the tank 20 parallel to its end surfaces. An overflow 25 is provided in the partition 26 to limit the amount of effluent that can be stored in the feed compartment 22. In addition, it will be noted that the overflow pipe 25 is designed to prevent the unmacerated excrement in the holding compartment 24 from entering the feed compartment 22 when the excrement in the holding compartment 24 is sloshed about by the rocking of the vehicle or marine craft on which the disposal system is located. The partition 26 is preferably located so that the volume of the holding compartment 24 is approximately three to four times greater than that of the feed compartment 22. Excrement is fed into the holding compartment 24 through a waste inlet 28 located at the top of the tank 20. The waste inlet 28 also serves as a vent through which gases from the holding compartment 24 are expelled.

Mounted to the top of the tank 20 over the partition 28 is the macerator pump and motor 30. The intake to the macerator 30 is provided through a large diameter pipe 32 that extends through an opening in the top of the tank 20 to the bottom of the holding compartment 24. The discharge from the macerator 30 is directed out of a smaller diameter pipe 34 into both the feed and holding compartments, 22 and 24 respectively. The macerator discharge pipe 34 extending into the holding compartment 24 contains an additional length of pipe 36 forming a T-joint near the bottom of the holding compartment 24, as shown. The openings at either end of the pipe 36 are substantially restricted so as to form nozzles 38. In this manner, the effluent discharged from the macerator 30 is expelled into the holding compartment 24 at an increased velocity to facilitate mixing of the effluent and waste material.

Also mounted to the top of the tank 20 of the macerator unit 14 is a liquid circulation pump 40 which circulates the macerated effluent through a circulation line 48 that extends from the macerator unit 14 to the incinerator unit 16 and back to the macerator unit 14. The liquid circulation pump 40 is operated by a motor 42 which drives the pump via a gear box 44. The liquid circulation pump 40 draws effluent from the feed compartment 22 through an opening in the top of the tank 20. The effluent is then circulated through the circulation line 48 that runs to the incinerator unit 16 and back to the feed compartment 22 of the macerator unit 14. The liquid circulation pump 40 circulates the effluent at a relatively high velocity so that the solid waste particles in the effluent do not settle and clog the circulation line 48. In addition, since the macerator unit 14 may be located quite remote from the incineration unit 16, the liquid circulation pump 40 is required to transport the effluent from the macerator unit 14 to the incinerator unit 16. It is important to note that the liquid circulation pump 40 must be of the reversible type so that the direction of effluent flow in the circulation line 48 can be reversed after the incineration cycle is completed. As will subsequently be explained in greater detail, this enables the circulation line 48 to be cleared of effluent before the system is deactivated so that the circulation line 48 does not become clogged from the accumulation of stagnant waste matter. Note also, that whereas the inlet pipe 46 of the liquid circulation pump extends to the bottom of the feed compartment 22, the return circulation line 48 from the incinerator unit 16 does not extend below the overflow 25 in the partition 26 between the two compartments. Accordingly, when the direction of the liquid circulating pump 40 is reversed after an incineration cycle, effluent from the feed compartment 22 is not drawn into the return circulation line 48 to prevent the clearing of the line.

Optionally, a stirrer or agitator 50 may be provided to circulate the macerated effluent within the feed compartment 22 during the operation of the system to prevent solid waste particles from settling to the bottom of the tank.

In operation, when the waste material in the holding compartment 24 reaches a predetermined level, a liquid level switch (not shown) disposed within the holding compartment 24 is activated initiating the operation of the system. As will subsequently be explained in greater detail in connection with the description of the control circuit 18 of the present system, the liquid circulation pump 40 is then activated to circulate effluent to the incinerator unit 16. For preselected periods during the operation of the system, the macerator pump and motor 30 are operated to macerate the waste from the holding compartment 24 and discharge the liquified effluent into the feed compartment 22 and back into the holding compartment 24. Since the macerator 30 can macerate waste material substantially faster than the incinerator unit 16 can dispose of it, the feed compartment 22 is always filled with effluent. In particular, whereas the incinerator unit 16 can only convert approximately a fourth of the capacity of the feed compartment 22 at a time, the macerator 30 can fill the feed compartment 22 with macerated excrement from the holding compartment 24 in approximately 1 minute. Thus, it will be understood that the effluent that is drawn from the feed compartment 22 and supplied to the incinerator unit 16 comprises waste material that was macerated during the previous operating cycle of the waste disposal system.

Figure 3:
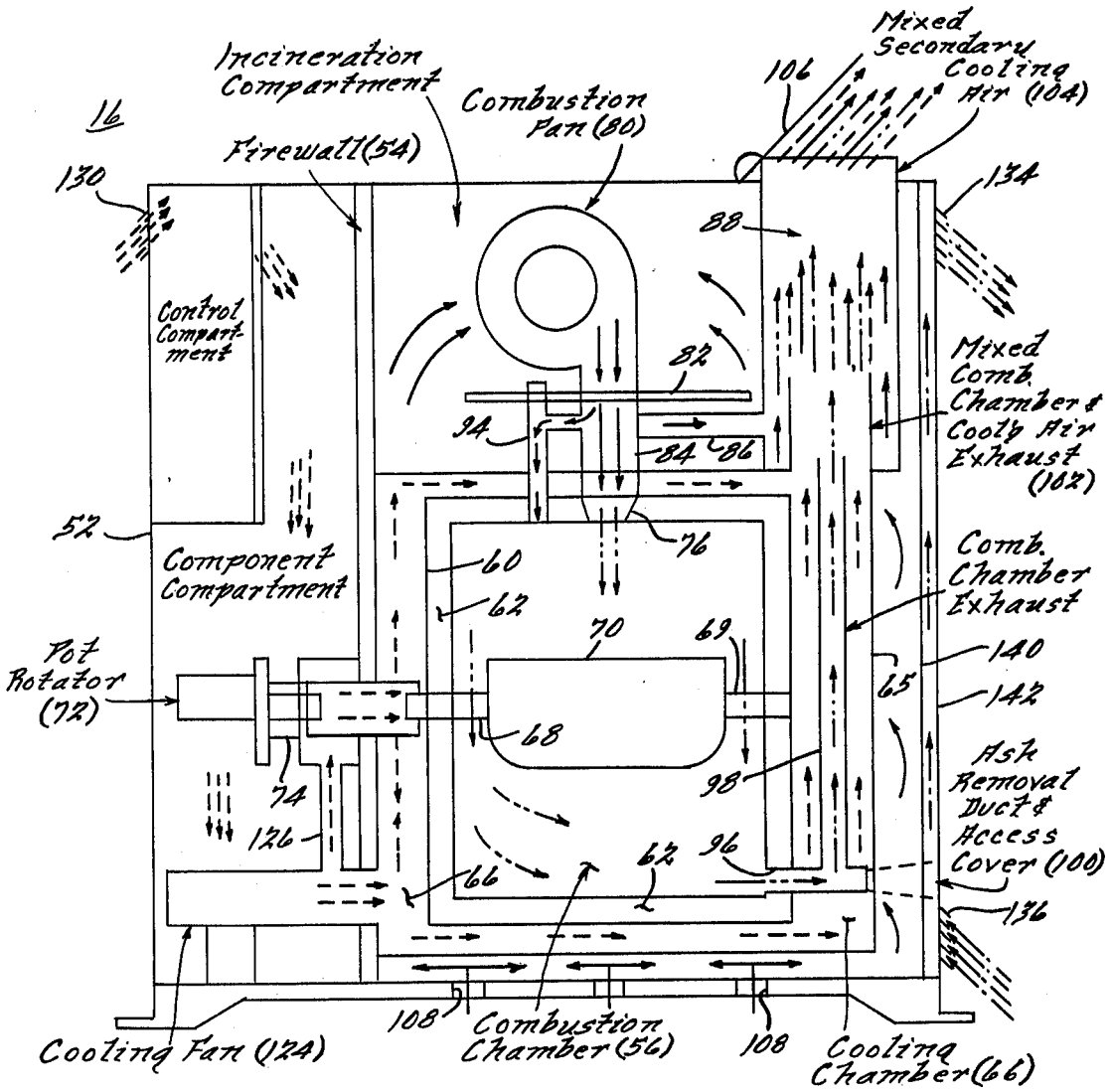
FIG. 3 is a diagrammatical view of the incinerator unit of the present invention.

Referring to FIG. 3, the general structure of the incinerator unit 16 will now be explained. The incinerator unit 16 is contained within a rectangular shaped cabinet having a front door panel 52 that is fastened to the main body of the unit by a piano hinge. The incinerator unit 16 essentially comprises three separate compartments; the incineration compartment, the component compartment which is separated from the incineration compartment by a fire wall 54, and the control compartment which is located on the inside of the front door panel 52 and houses the electronic control circuit 18.

Located within the incineration compartment is the combustion chamber 56. The combustion chamber 56 comprises cylindrically shaped inner and outer shells, 58 and 60 respectively, that are separated by a layer of insulation 62. As can best be seen in FIG. 7, the combustion chamber 56 is elevated from the floor of the incinerator unit 16 by supporting members 64, and spaced from the walls of the compartment so as to define an air space completely surrounding the combustion chamber. This air space comprises the primary cooling chamber 66 for the incinerator unit 16 and is utilized to dissipate most of the heat generated within the combustion chamber 56. Disposed within the combustion chamber 56 is a crucible 70 comprised of a hemispherically shaped pot. The crucible 70 is suspended within the combustion chamber 56 on opposing sides by a pair of aligned shafts 68 and 69 supported by the walls 58 and 60 of the chamber 56. Shaft 68 extends through the fire wall 54 into the component compartment of the incinerator unit 16 and is connected to a pot rotator motor 72 and electrical clutch 74 which are utilized to rotate the crucible 70 within the combustion chamber 56, as will subsequently be described.

Figure 8:
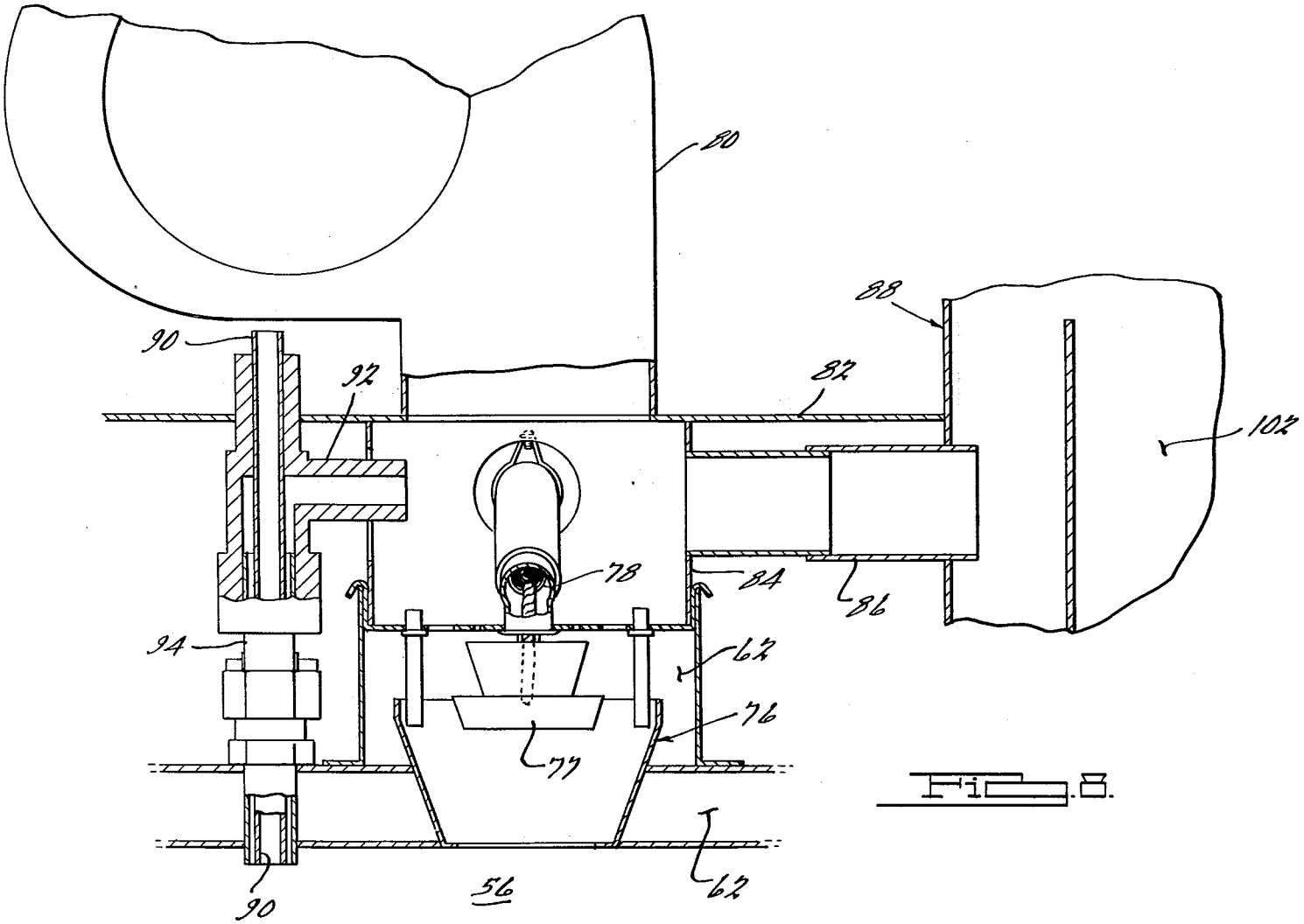
FIG. 8 is another partial view of the incinerator unit.

As is best shown in FIG. 8, mounted to the top of the combustion chamber 56 is a high temperature burner 76, which may be oil fired, or operated with any other suitable liquid or gaseous fuel. The burner 76 utilized in the preferred embodiment herein is manufactured by Stewart-Warner Corporation, model number 10530-A24 heater, although comparable burners can, of course, be employed. The present burner 76 is adapted to operate off the same fuel that is used in the engine of the vehicle or craft. In this manner, the need for an alternative fuel supply is eliminated. The discharge of the burner 76 has a truncated conical shape as shown, that is adpated to direct a flame downwardly into the combustion chamber 56. During operation, the flame from the burner 76 is of such magnitude that the entire combustion chamber 56 is engulfed in flame. In connection therewith, it is important that the crucible 70 be suspended from the floor and spaced from the walls of the combustion chamber 56. In this manner, the flame from the burner 76 is deflected off the walls and floor of the combustion chamber 56 so that heat is directly applied to all sides of the crucible 70. As will be appreciated by those skilled in the art, this causes a more complete burning of the effluent, which in turn prevents the effluent from caking inside the crucible 70 after repeated operations of the system. Accordingly, the efficiency of the incineration unit 16 is maintained over prolonged periods of use.

Located inside the burner 76 adjacent the burner head 77 is an ignitor or glow plug 78. The glow plug 78, which is analogous to the cigar lighter in an automobile, is adapted to be energized prior to ignition of the burner 76 to provide the "spark" that ignites the burner 76. Once it is fired, the burner 76 can independently sustain its flame and the glow plug 78 can be deenergized.

Mounted above the cylindrical air intake 84 of the burner 76 is a forced draft combustion fan 80. The combustion fan 80 is connected to an adaptor plate 82 which is provided to conform the rectangular-shaped discharge nozzle of the fan 80 to the circular-shaped air intake 84 of the burner 76. The combustion fan 80 provides the express air required to support the high temperature flame of the burner 76. Coupled to the cylindrical air intake 84 of the burner 76 and extending radially therefrom is an air duct 86 which ties into the exhaust unit 88 of the incineration unit 16. As will subsequently be explained in connection with the description of FIG. 3, the air duct 86 bleeds a portion of the air discharged by the combustion fan 82 into an exhaust mixing chamber 104 where it is mixed with the exhaust gases from the combustion chamber 56 to cool the exhaust gases before they are expelled from the incineration unit 16.

Figure 5:
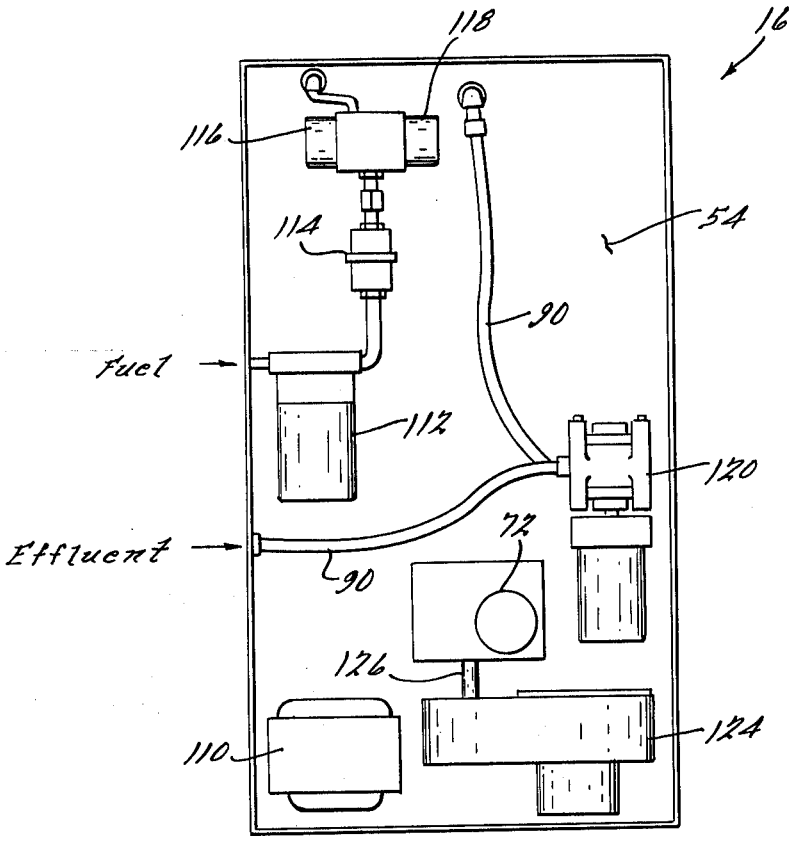
FIG. 5 is a plan view of the component compartment of the incinerator unit.

Also extending through the ceiling of the combustion chamber 56 above the crucible 70 is the effluent feed line 90 which is mounted normal to the top surface of the combustion chamber 56 alongside the burner 76. The effluent feed line 90 extends from the combustion chamber 56 through an opening in the firewall 54, as shown in FIG. 5, and is connected to the outlet of the feed pump 120 located in the component compartment of the incineration unit 16. The termination of the effluent feed line 90 within the combustion chamber 56 is of necessity relatively close to the burner 76 so that the effluent from the feed line will be dispensed into the crucible 70 suspended below. Although the burner 76 is completely surrounded by a layer of insulation 62, the feed line 90 adjacent the burner 76 is still exposed to a significant amount of the heat. If left unattended, the heat from the burner 76 could result in a sufficient heating of the feed line 90 to cause the effluent within the feed line 90 to cake and create a blockage in the line. In order to prevent this from occurring, another bleed line 92 is coupled to the cylindrical air intake 84 of the burner 76 and connected to a conduit 94 which jackets the feed line 90 adjacent the burner 76. In this manner, a stream of cooling air is bled from the combustion fan 80 and directed around the feed line 90 to prevent the heat radiating from the burner from heating the effluent within the feed line 90. The cooling of the feed line 90 thus insures a smooth flow of effluent into the combustion chamber 56 even when the burner 76 is at operating temperature.

Figure 7:
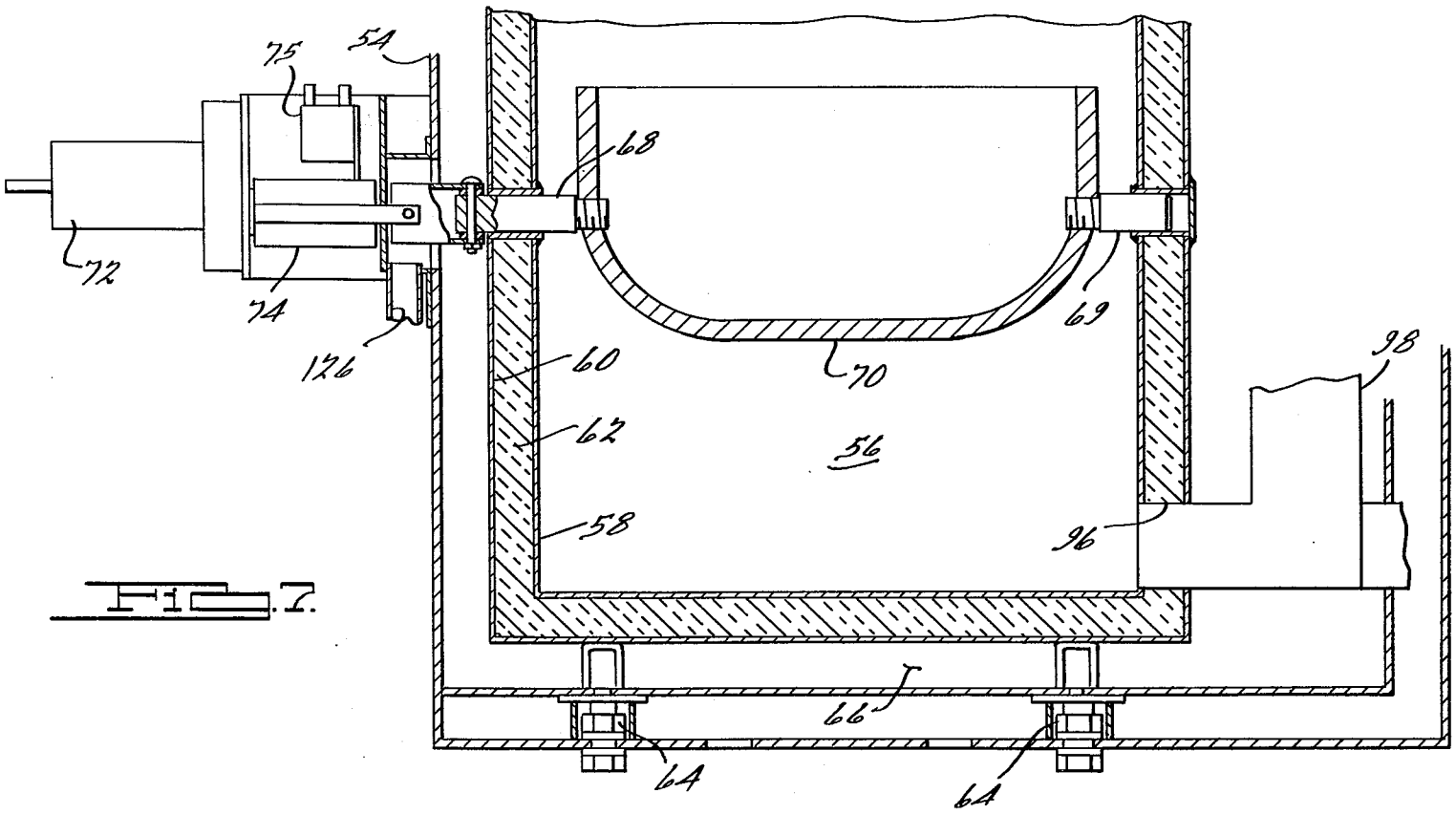
FIG. 7 is a partial view of the incinerator unit.

Referring specifically to FIGS. 3 and 7, the exhaust from the combustion chamber 56 is directed out an opening 96 in the wall near the floor of the combustion chamber 56 and into an exhaust stack 98. As best shown in FIG. 3, the exhaust stack 98 extends slightly above the top surface of the combustion chamber 56 so that the exhaust gases expelled from the top of the exhaust stack 98 are mixed with the cooling air from the primary cooling chamber 66 in a first exhaust mixing chamber 102. The mixed exhaust air is then directed into a second mixing chamber 104 where the gases are mixed again with the secondary cooling air that is bled from the combustion fan 80 through the air duct 86 previously described. The top of the exhaust unit 88 is covered by a counter-weighted exhaust cap 106 which opens when the cooling and combustion fans are activated.

Located at the base of the exhaust stack 98 is an ash removal duct 100. The duct 100 provides access to the combustion chamber 56 from the rear of the incineration unit 16. By removing the access cover (not shown) that fits on the outside rear panel of the unit, convenient access is provided to the floor of the combustion chamber 56 for removing the ash that is dumped from the crucible 70. However, since only approximately 15 grams of solid waste material is generated for every gallon of excrement disposed, the combustion chamber 56 requires infrequent cleaning.

Referring now to FIG. 5, a plan view of the component compartment of the incinerator unit 16 is shown. The component compartment houses the various mechanical components of the incinerator unit 16 which are operated under the control of the electronic control unit 18. The transformer 110 located at the base of the compartment is provided so that the system may be operated under conventional 115 volt outlet current, which is typically available for hook-up at docks and campsites. A fuel pump 112 mounted to the firewall 54 draws fuel from a remote tank and pumps the fuel through a fuel filter 114 to the burner 76 located on the opposite side of the firewall 54. As previously mentioned, the burner 76 used in the preferred embodiment is adapted to operate with ordinary automotive fuel. Accordingly, the fuel line to the fuel pump 112 will typically be routed to the fuel tank of the vehicle. The amount of fuel supplied to the burner 76 is regulated by a pair of fuel valves 116 and 118. Each valve is adapted to provide approximately one half of the total allowable fuel flow. As will subsequently be explained in greater detail, the primary fuel valve 116 is always open while the burner 76 is operating, and the secondary fuel valve 118 is cycled between its opened and closed positions under the control of the electronic control unit 18 in accordance with the temperature of the exhaust gases from the combustion chamber 56.

As stated previously, effluent is pumped from the macerator unit 14 to the incinerator unit 16 by the liquid circulation pump 40 located on the macerator unit 14. However, the liquid circulation pump 40 does not pump effluent directly into the combustion chamber 56 of the incinerator unit 16. This is primarily due to the fact that the macerator unit 14 will frequently be located quite remote from the incinerator unit 16. Thus, it may require a finite period of time for the liquid circulation pump 40 to pump the effluent from the macerator unit 14 to the incinerator unit 16. Accordingly, it can be appreciated that it would otherwise be extremely difficult for the control unit 18 to accurately control the amount of effluent that is fed into the combustion chamber 56. In addition, when the macerator unit 14 is located a significant distance from the incinerator unit 16, it becomes desirable to pump the effluent through the lengthy circulation line 48 at a relatively high velocity so that the solid waste matter in the effluent does not settle and clog the line. Consequently, is such a situation, the rate of effluent flow through the circulation line 48 is too rapid to safely dispense the effluent from the circulation line 48 directly into the crucible 70.

Figure 6:
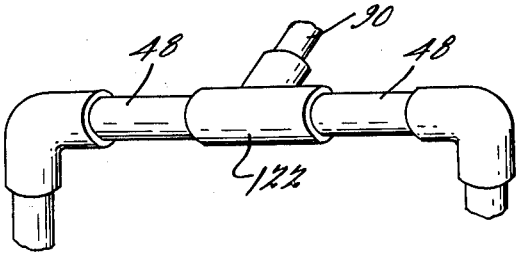
FIG. 6 is an illustration of the take-off from the circulation line to the incinerator unit.

Accordingly, the present invention utilizes an additional feed pump 120 which draws effluent from the circulation line 48 and feeds it into the crucible 70 within the combustion chamber 56. Referring specifically to FIG. 6, a T-joint 122 is inserted in the circulation line 48 outside the incinerator unit 16, and the branch from the T-joint 122 is connected through a feed line 90 to the feed pump 120. Thus, when it is desired to feed effluent into the combustion chamber 56, the feed pump 120 is activated and effluent is drawn off the circulation line 48. It should be noted, that only a fraction of the effluent that is circulated past the T-joint 122 through the circulation line 48 is drawn into the feed line 90 by the feed pump 120. In particular, the rate at which effluent is fed into the combustion chamber 56 is determined by the capacity of the feed pump 120. As will subsequently be described in greater detail, during the operation of the system, the liquid circulation pump is continuously activated so that effluent from the macerator unit 14 will always be present at the T-joint 122 as required. In this manner, the amount of effluent fed into the crucible 70 within the combustion chamber 56 can be accurately controlled by controlling the activation of the feed pump 120.

Once the effluent within the crucible 70 has been completely incinerated to a fine ash, it is desirable to remove the ash from the crucible 70. To accomplish this, a pot rotator motor 72 and electric clutch 74 (FIG. 7) are connected to the shaft 68 from which the crucible 70 is suspended within the combustion chamber 56. After completion of the incineration cycle, the control unit 18 is adapted to automatically activate the pot rotator motor 72 and clutch 74 to rotate the crucible 70. Accordingly, the waste material remaining in the crucible 70 is dumped to the floor of the combustion chamber 56. This not only prevents the accumulation of waste matter in the crucible 70, but also serves to dispense the waste material to a location where it can more readily be removed from the incinerator unit 16. Specifically, the floor of the combustion chamber is easily cleared of the dumped waste material simply by inserting a suction hose through the ash removal duct 96 located at the rear of the incinerator unit 16.

As can best be seen in FIG. 7, a microswitch 75 is also provided which is mounted adjacent to the shaft of the motor 72 so as to be actuable by a camming surface integral to the shaft as a means of indicating the upright position of the crucible 70. Specifically, the electronic control unit 18 is adapted to deactivate the clutch 74 to cease rotation of the crucible 70 when the microswitch 75 indicates that a complete revolution has occurred. In this manner, it is assured that the crucible 70 is in the proper upright position at the termination of the system's operation.

The final component located in the component compartment of the incinerator unit 16 is the primary cooling fan 124. The primary cooling fan 124 comprises a forced draft cooling fan similar to the combustion fan 80 mounted within the incinerator compartment above the combustion chamber 56. The air from the primary cooling fan 124 is discharged through an opening in the fire wall 54 into the primary cooling chamber 66 which completely surrounds the combustion chamber 56. As will be more fully explained in connection with the description of FIGS. 3 and 4, the air discharged by the primary cooling fan 124 is circulated through the primary cooling chamber 66 to dissipate the heat from the combustion chamber 56, and then mixed with the exhaust gases from the combustion chamber 56 before being expelled from the exhaust unit 88 of the incinerator 16.

As can also be seen from FIGS. 5 and 7, a bleed line 126 is provided from the discharge of the primary cooling fan 124 to the shaft of the pot rotator motor 72 where it is coupled to the shaft 68 extending through the fire wall 54. As will also be explained in connection with the description of FIG. 3, the discharged air bled from the primary cooling fan 124 is utilized to cool the shaft of the pot rotator motor 72 to prevent the heat from the combustion chamber 56 from being conducted along the shaft 68 and overheating the motor 72.

Figure 4:
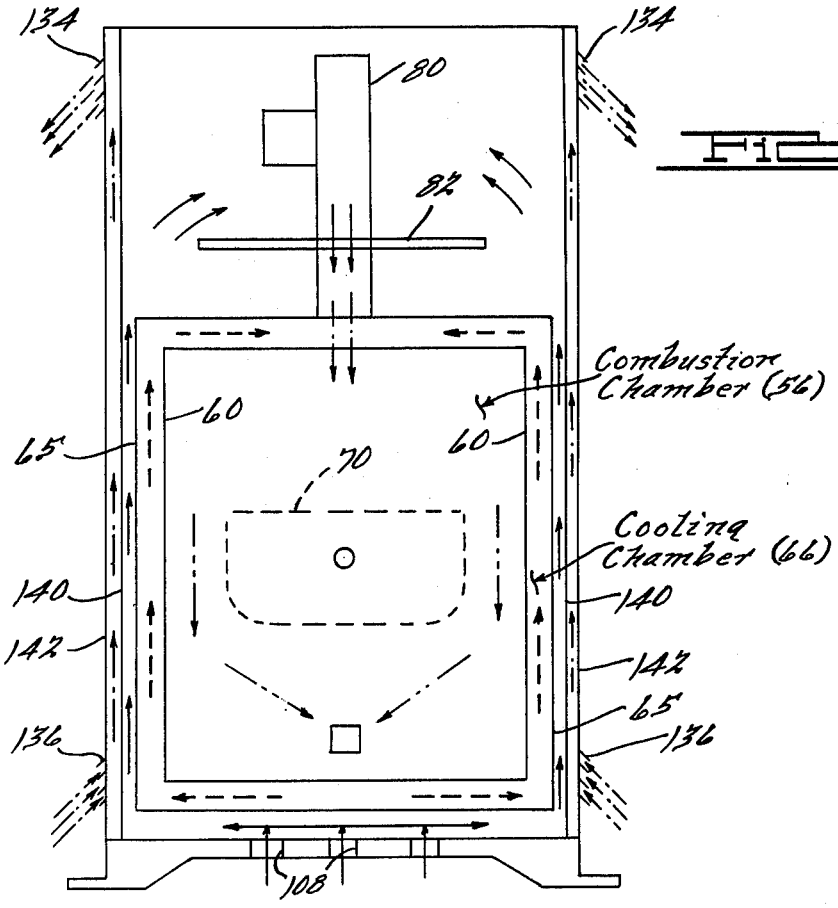
FIG. 4 is another view of the incinerator unit illustrated in FIG. 3.

Due to the extremely high temperatures at which the present waste disposal system operates, the manner in which the incineration unit 16 is cooled constitutes an important part of the present invention. Referring to FIGS. 3 and 4, the entire cooling of the incineration unit 16 is performed by two fans; the cooling fan 124 and the combustion fan 80. Each fan, however, performs multiple cooling functions. The discharge from the primary cooling fan is provided directly through an opening in the firewall 54 into the primary cooling chamber 66, as explained. The primary cooling chamber 66 comprises the air space between the outer shell 60 of the combustion chamber 56 and the combustion chamber housing 65. As the Figures illustrate, the primary cooling chamber 66 completely surrounds the combustion chamber 56. This is important from the standpoint that it prevents excessive heat buildup in any one area of the combustion chamber 56. In addition, it will be noted that the primary cooling chamber 66 also completely surrounds the exhaust stack 98 at the rear of the combustion chamber 56. In this manner, the forced air from the primary cooling fan 124 dissipates the heat from the exhaust stack 98 as well. As best shown in FIG. 3, the primary cooling chamber 66 extends slightly above the exhaust stack 98 of the combustion chamber 56 to provide a chamber 102 wherein the cooling air from the primary cooling chamber 66 can mix with the exhaust gases from the combustion chamber 56 to cool the exhaust gases before they are expelled from the incineration unit 16.

An additional function performed by the primary cooling fan 124 is the cooling of the shaft of the pot rotator motor 72. In particular, a bleed line 126 is provided from the discharge side of the cooling fan 124 to the output shaft of the pot rotator motor 72 where it couples to the shaft 68 extending from the combustion chamber 56. A portion of the discharged air from the cooling fan 124 is directed through the bleed line 126 along the shaft of the motor 72 and through an opening in the firewall 54 into the primary cooling chamber 66. From there, the air flows around the combustion chamber 56 and is discharged through the exhaust mixing chamber 102 of the exhaust unit 88 as previously described. The cooling of the shaft of the pot rotator motor 72 is important to prevent the motor from overheating. Specifically, due to the direct mechanical connection between the pot rotator motor 72 and the crucible 70 within the combustion chamber 56, the thermal conduction along the shaft 68 would, absent the cooling means provided, be sufficient to damage the motor 72. Accordingly, by cooling the shaft of the pot rotator motor 72, significant heat flow from within the combustion chamber to the pot rotator motor 72 is avoided.

Finally, it will be noted that the suction side of the primary cooling fan 124 draws ambient air through the louvers 130 located at the top of the outside front panel 52 of the incinerator unit 16, and through the control compartment containing the electronic control unit 18. As will be explained in connection with the description of the control unit 18, the electronic control circuit includes a high power switching panel that is mounted within the control compartment. As those skilled in the electronics art will appreciate, the switching panel generates a substantial amount of heat. Thus, by drawing ambient air over the control compartment, the primary cooling fan 124 serves to dissipate the heat from the control unit 18 as well.

The combustion fan 80 located directly above the burner 76, also serves several important cooling functions. Specifically, in addition to providing express combustion air for the burner 76, a portion of the discharged air from the fan 80 is provided through an air duct 86 to a second exhaust mixing chamber 104 wherein the air from the combustion fan 80 is combined with the exhaust gases and primary cooling air mixture. Thus, the exhaust gases from the combustion chamber 56 are mixed twice with cooling air before being discharged from the incinerator unit 16.

The discharge from the combustion fan 80 also serves to cool the part of the effluent feed line 90 that extends into the combustion chamber 56. As previously explained, a bleed line 92 located proximate the discharge nozzle of the combustion fan 80 is joined to a pipe 94 which jackets the length of feed line 90 adjacent the burner 76, as shown in FIG. 8. In this manner, a portion of the air discharged from the combustion fan 80 is directed into the pipe jacket around the effluent feed line 90 and down into the combustion chamber 56. By directing cooling air along this part of the feed line 90, the effluent within the line is prevented from getting excessively hot due to the heat from the combustion chamber 56. This is important since the feed line 90 is of necessity located within close proximity to the burner and therefore is otherwise apt to become extremely hot. If the feed line 90 is allowed to get hot, the effluent inside will froth and cake to the sides of the feed line 90, thereby inhibiting the flow of effluent. Eventually, this would cause the feed line 90 to become completely clogged and all flow would be terminated. Accordingly, it can be seen that the cooling air bled from the combustion fan 80 and directed around the feed line 90 is necessary to insure that the effluent flows smoothly into the combustion chamber 56.

Finally, the suction side of the combustion fan 80 performs an overall secondary cooling function by drawing ambient air through openings 108 in the bottom of the incinerator unit 16 and circulating the ambient air around the entire combustion chamber 56. Specifically, as best illustrated in FIG. 4, the ambient air drawn through the openings 108 in the bottom of the incinerator unit 16 is directed between the combustion chamber housing 65 and the inner housing panel 140 of the incinerator unit 16. Thus, it can be seen that a secondary cooling chamber is provided that completely surrounds the primary cooling chamber 66 to further dissipate the heat from the combustion chamber 56.

In addition, the normal gravity flow of air causes ambient air to flow through the louvers 136 at the bottom of the outer housing side panels 142, up the space between the inner and outer housing panels 140 and 142 respectively, and out the louvers 134 at the top of the outer housing side panels 142. Accordingly, radiant heat from the combustion chamber 56 that passes through the insulation layer 62 between the inner and outer combustion shells, 58 and 60 respectively, is cooled by three separate air flows before passing outside the incinerator unit 16. Thus, it will be appreciated that the outer walls of the incinerator unit 16 remain remarkably cool even at the peak operating temperatures of the unit.

As previously stated, the operation of the entire system is controlled by an electronic control unit 18 which, in the preferred embodiment herein, is located inside the front door panel 52 of the incinerator unit 16. The control unit 18 utilized in the preferred embodiment comprises a completely solid state circuit. However, as will be readily apparent to those skilled in the electronics art, a control unit utilizing a microprocessor programmed to perform the same functions as the present solid state control unit 18 can also be employed. The control unit 18 is essentially adapted to control the various sequence of events which occur during the disposal system's operation, and continuously monitor the system to insure that it is operating within certain critical parameters. If at any time a condition arises which does not fall within these parameters, the control unit 18 is adapted to automatically remove power from all mechanical components, except the fans, until the system has cooled below 300° F., and then completely shut down the system. Under such a situation, a trouble light on the front of the incinerator unit 16 or a remote control panel is illuminated to indicate that the unit must be serviced before it can again be safely operated.

Figure 9:
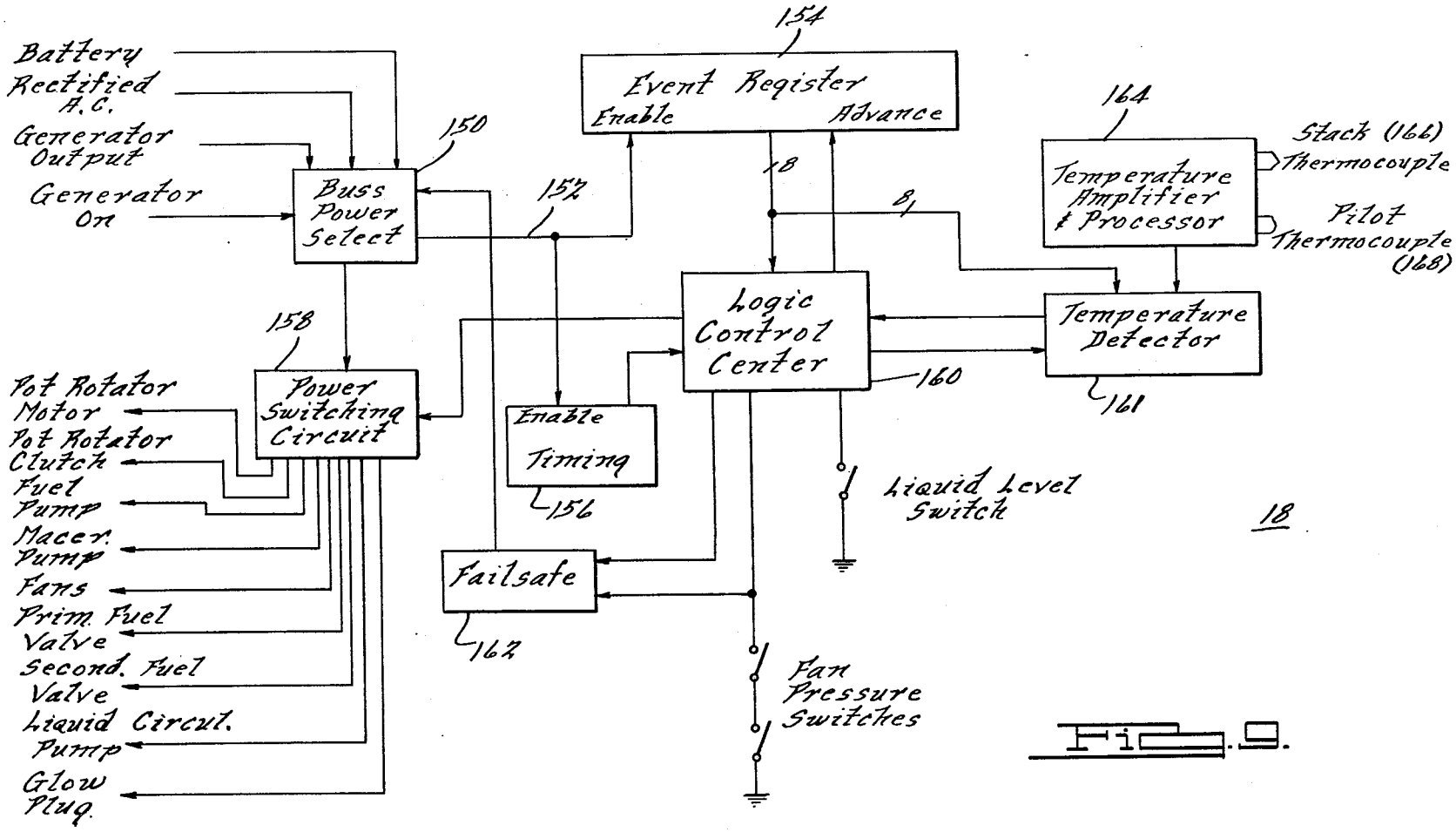
FIG. 9 is a block diagram of the electronic control circuit of the present invention.
Figure 10:
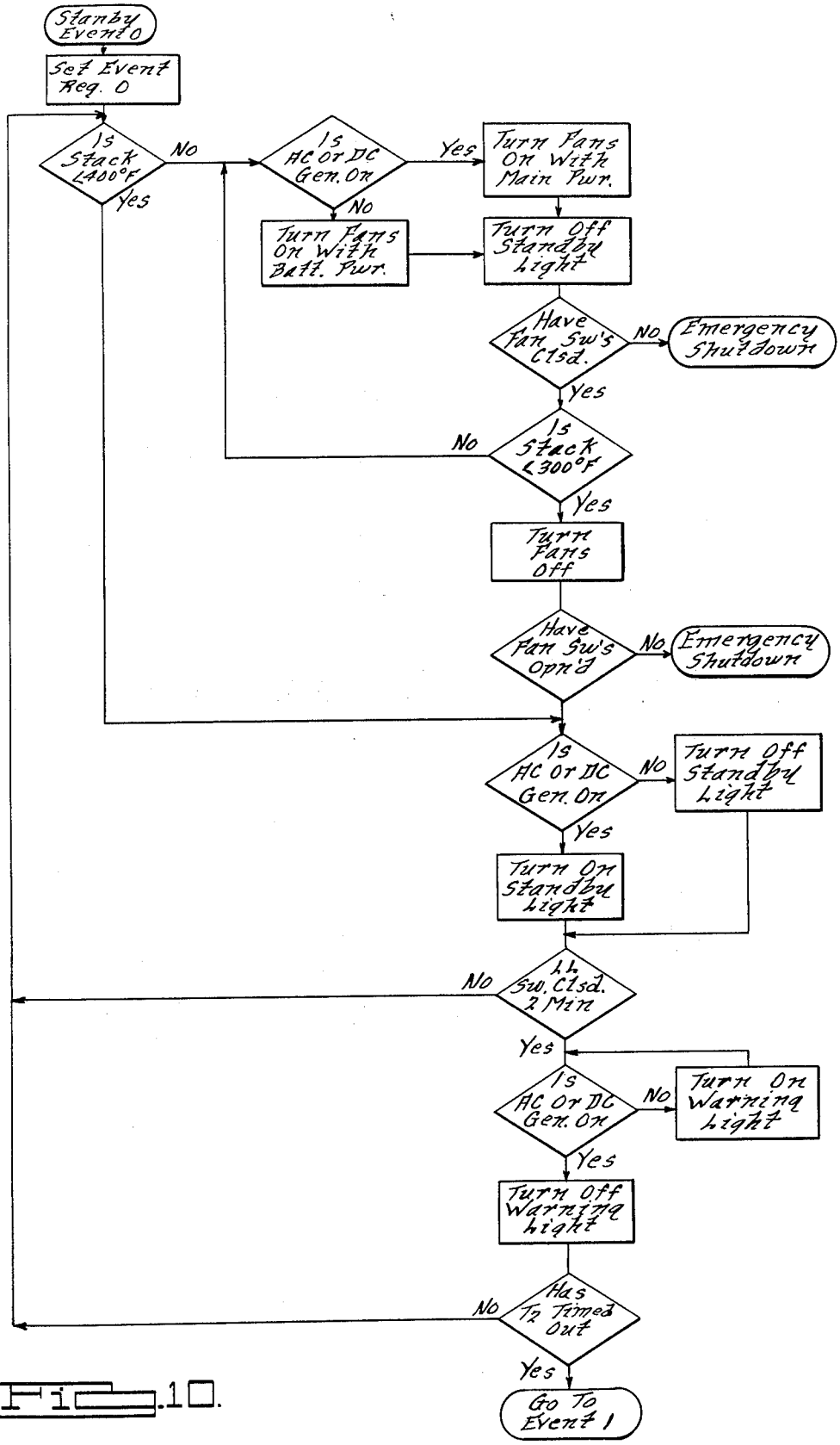
FIGS. 10 through 17 are block diagrams which represent the sequence of events which occur during the operation of the present invention.
Figure 11:
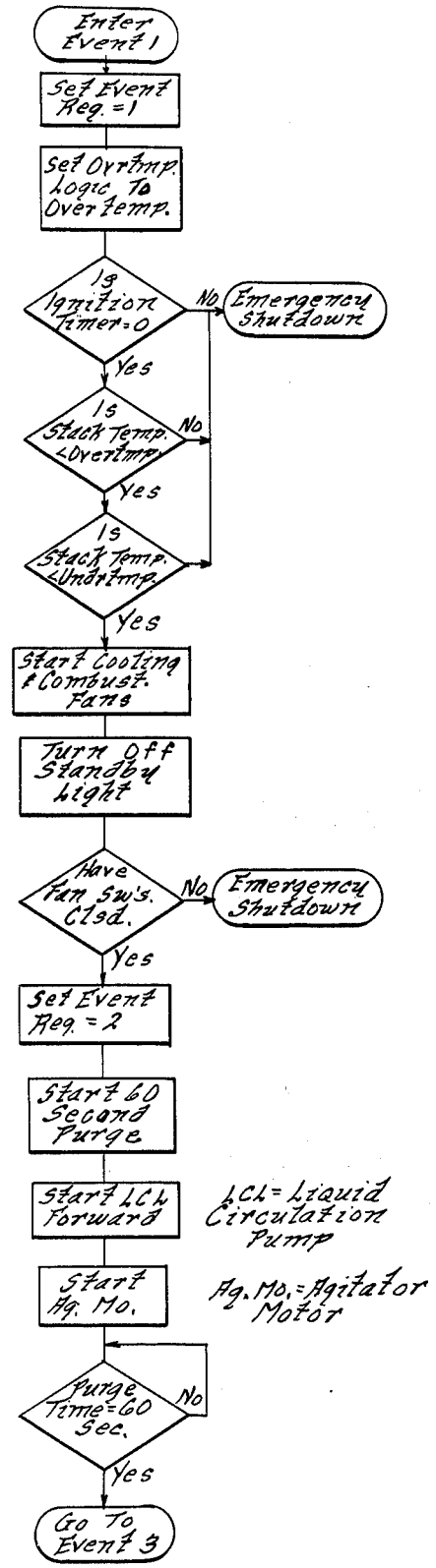
Figure 12:
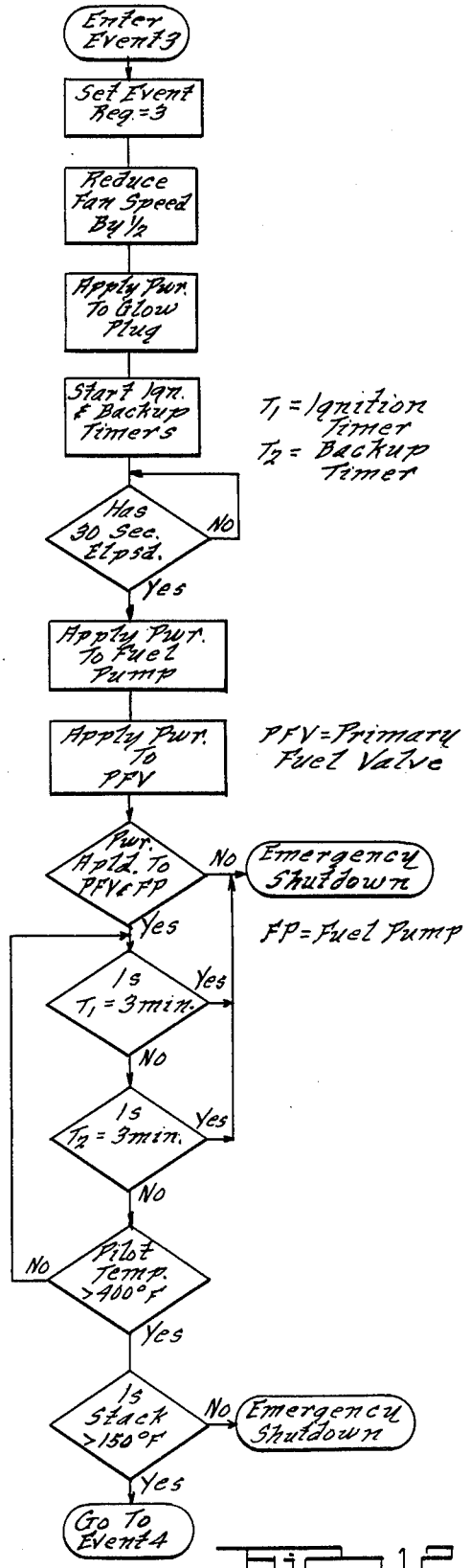
Figure 13:
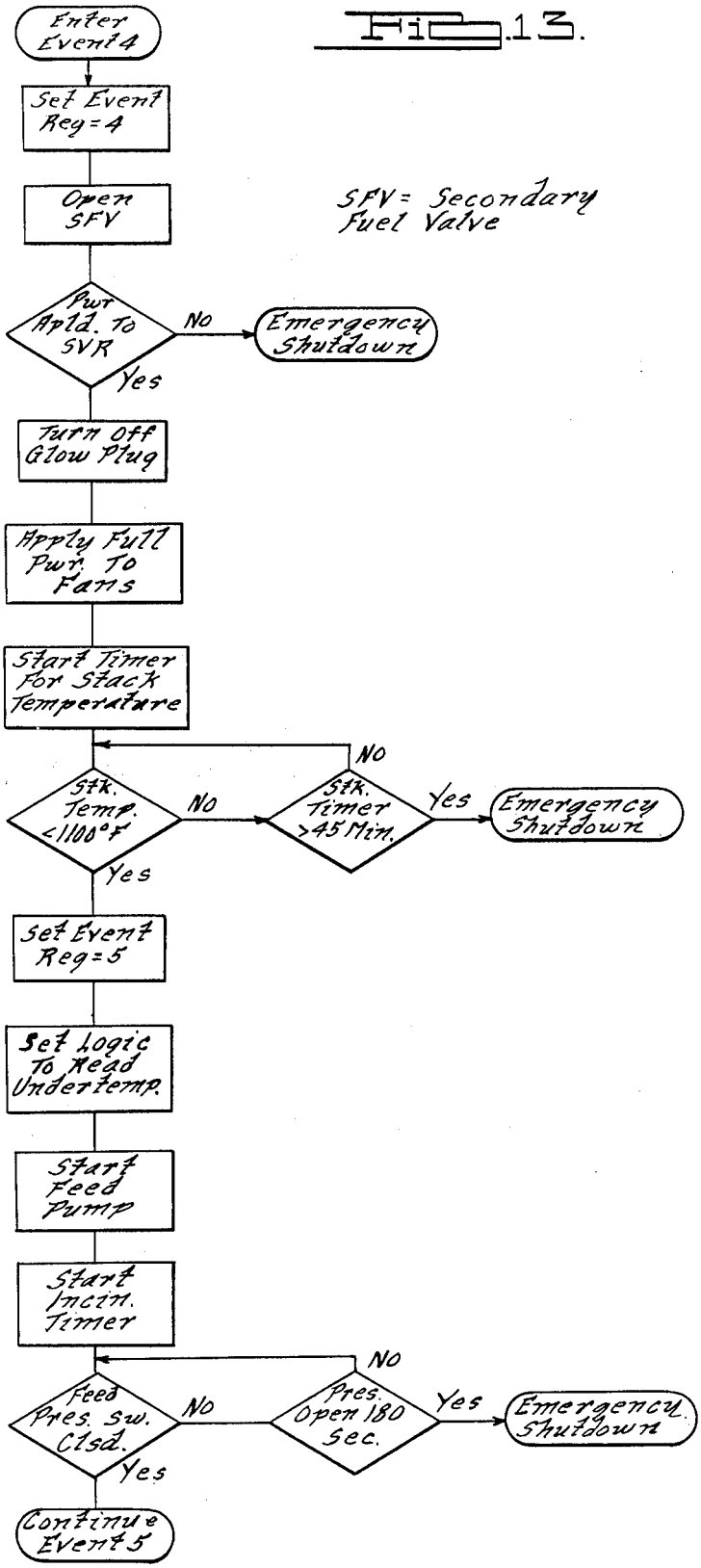
Figure 14:
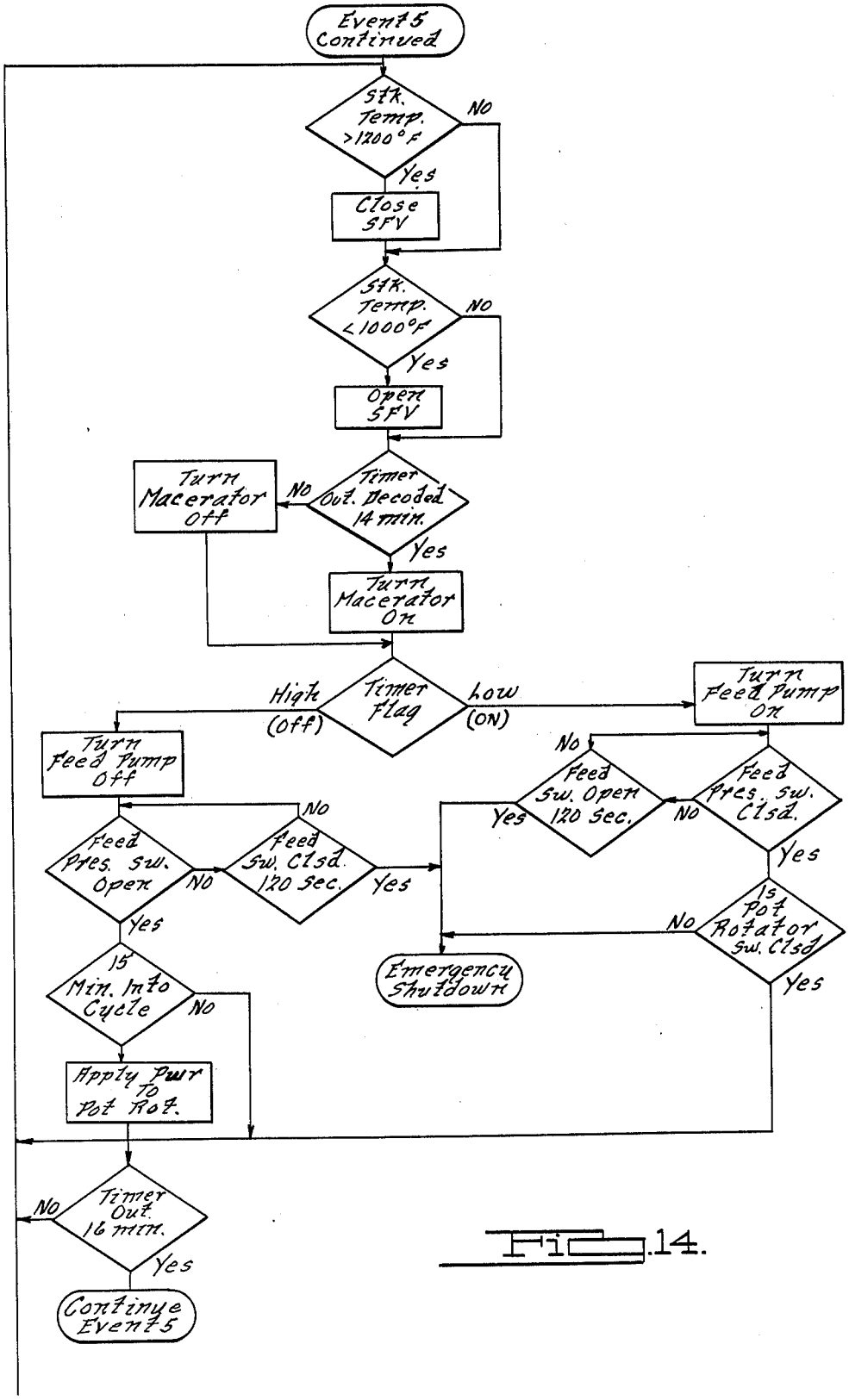
Figure 15:
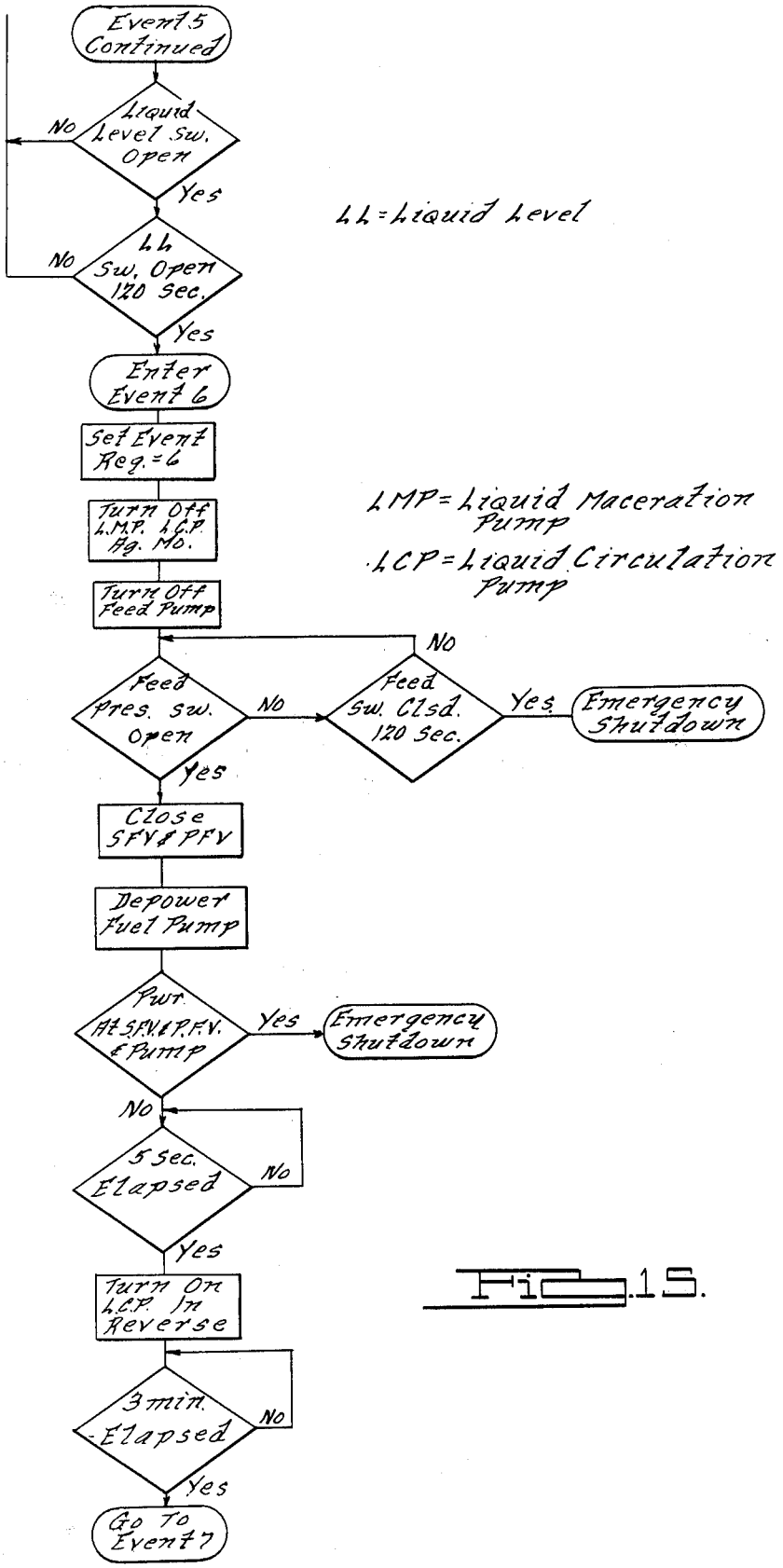
Figure 16:
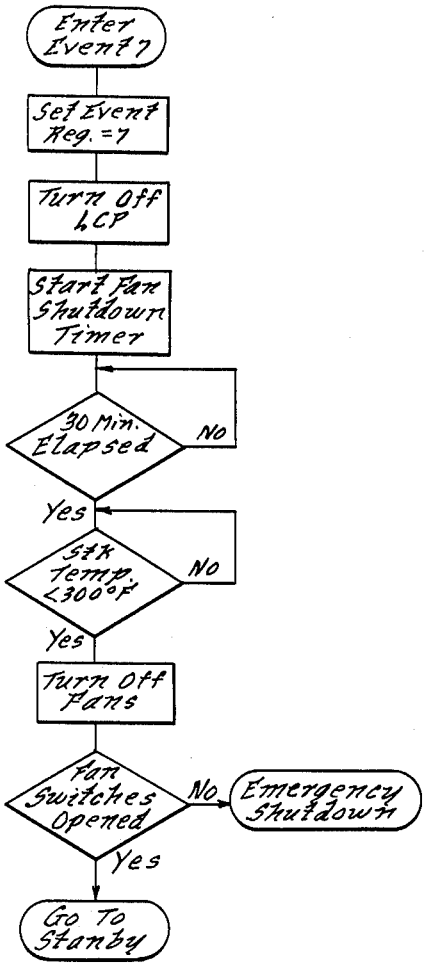
Figure 17:
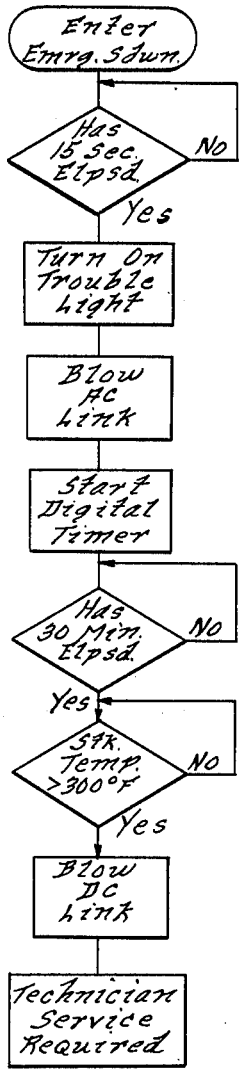
Figure 18:
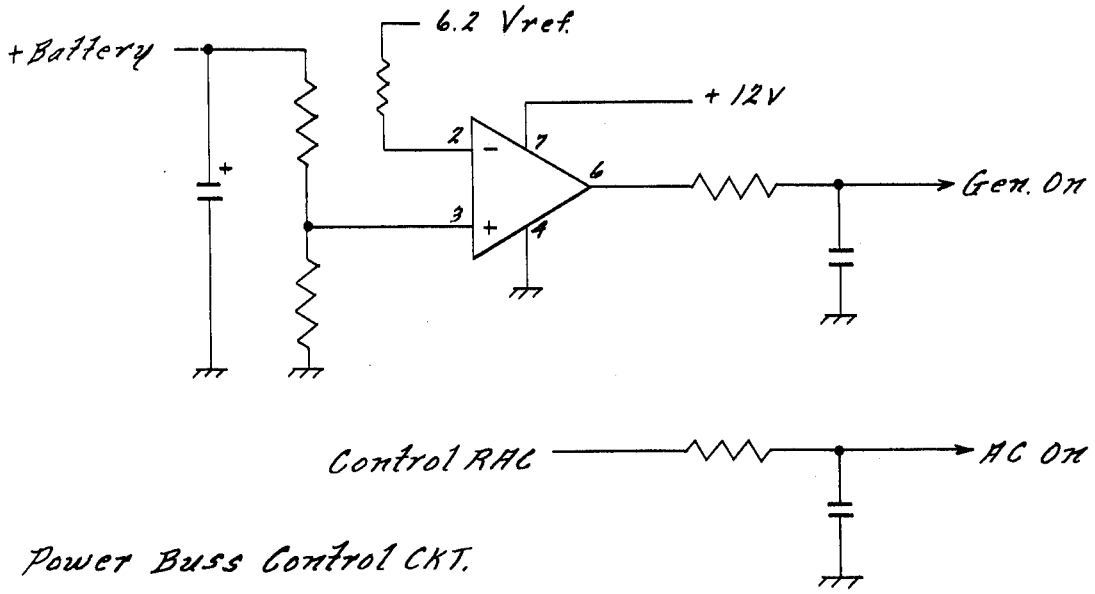
Figure 19:
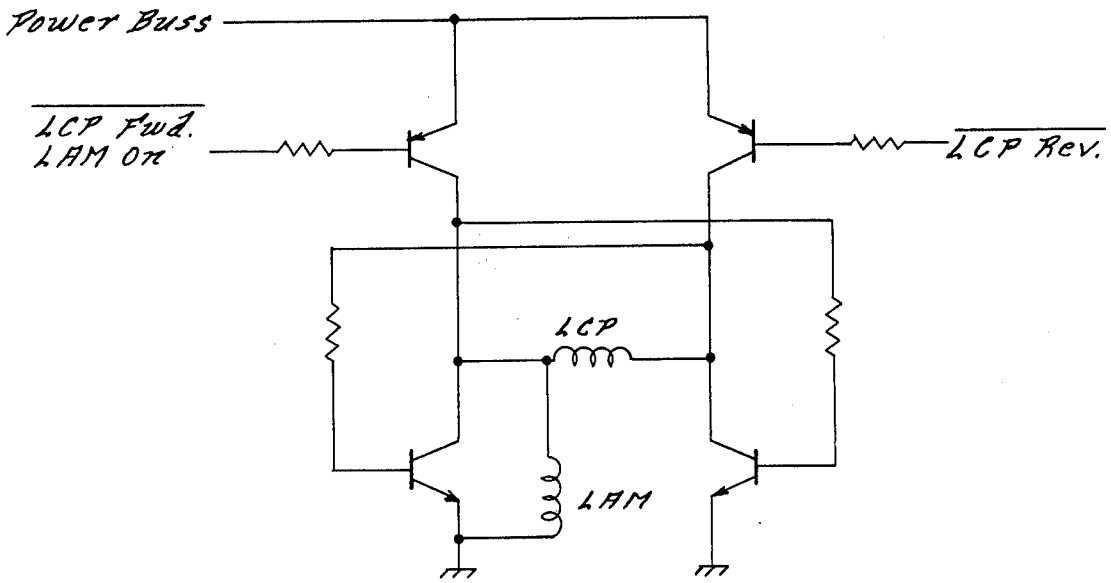
Figure 20:
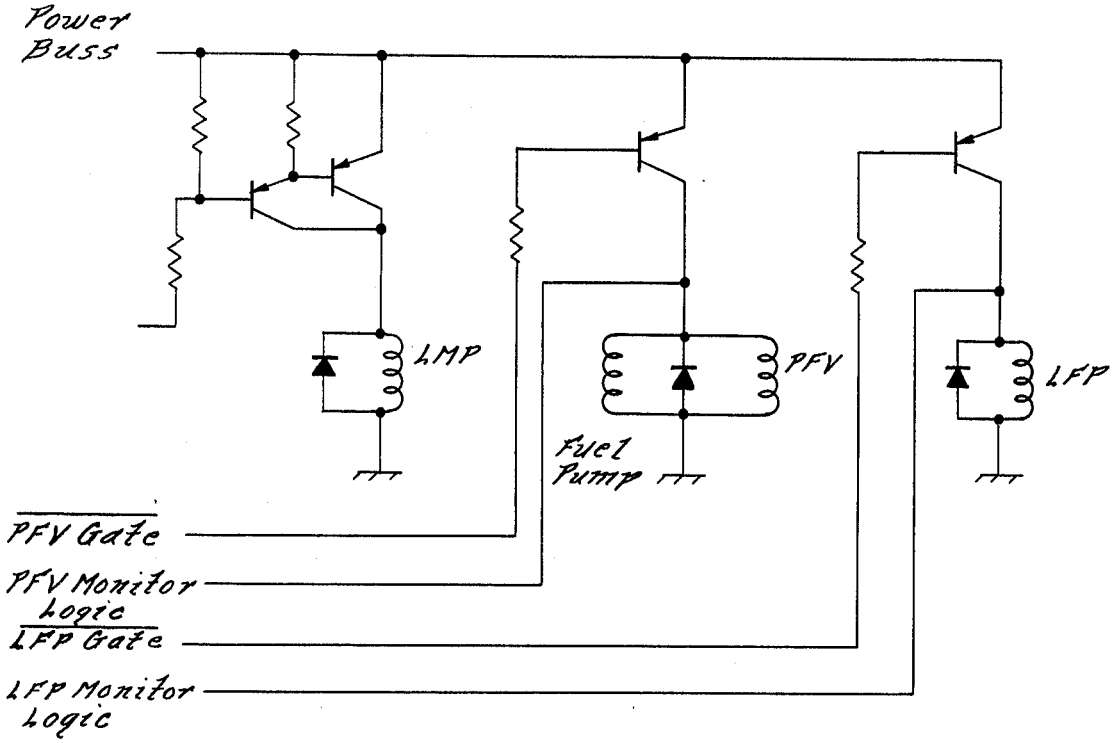
Figure 21:
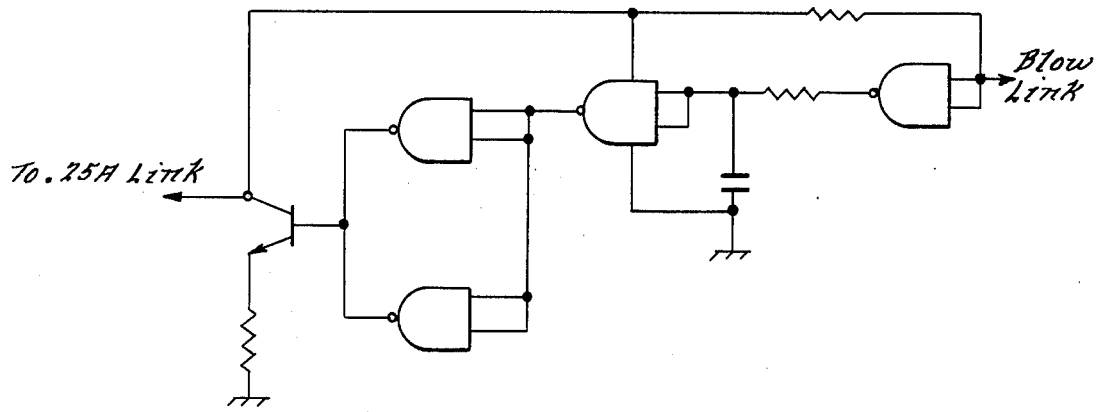
Figure 22:
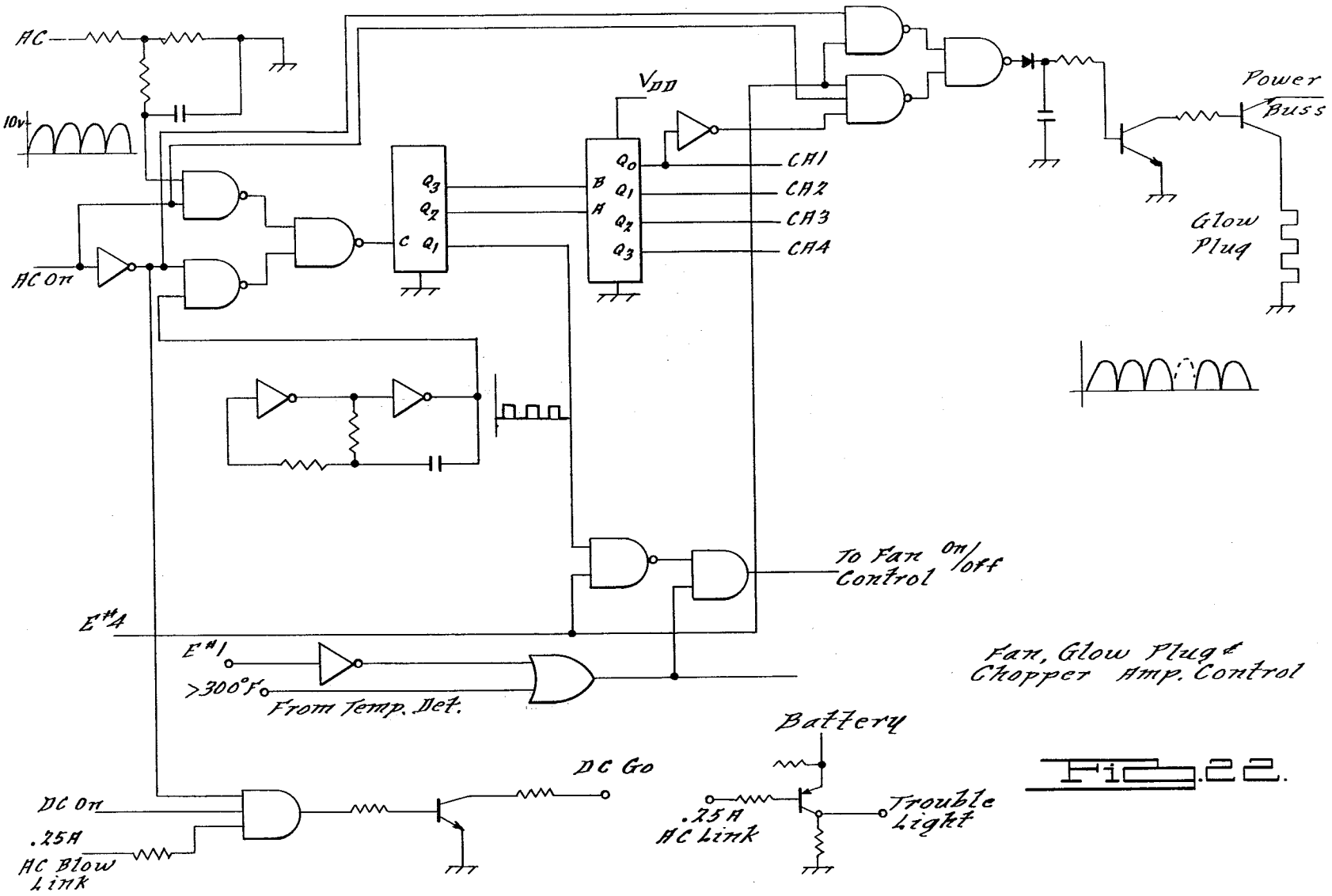
Figure 23:
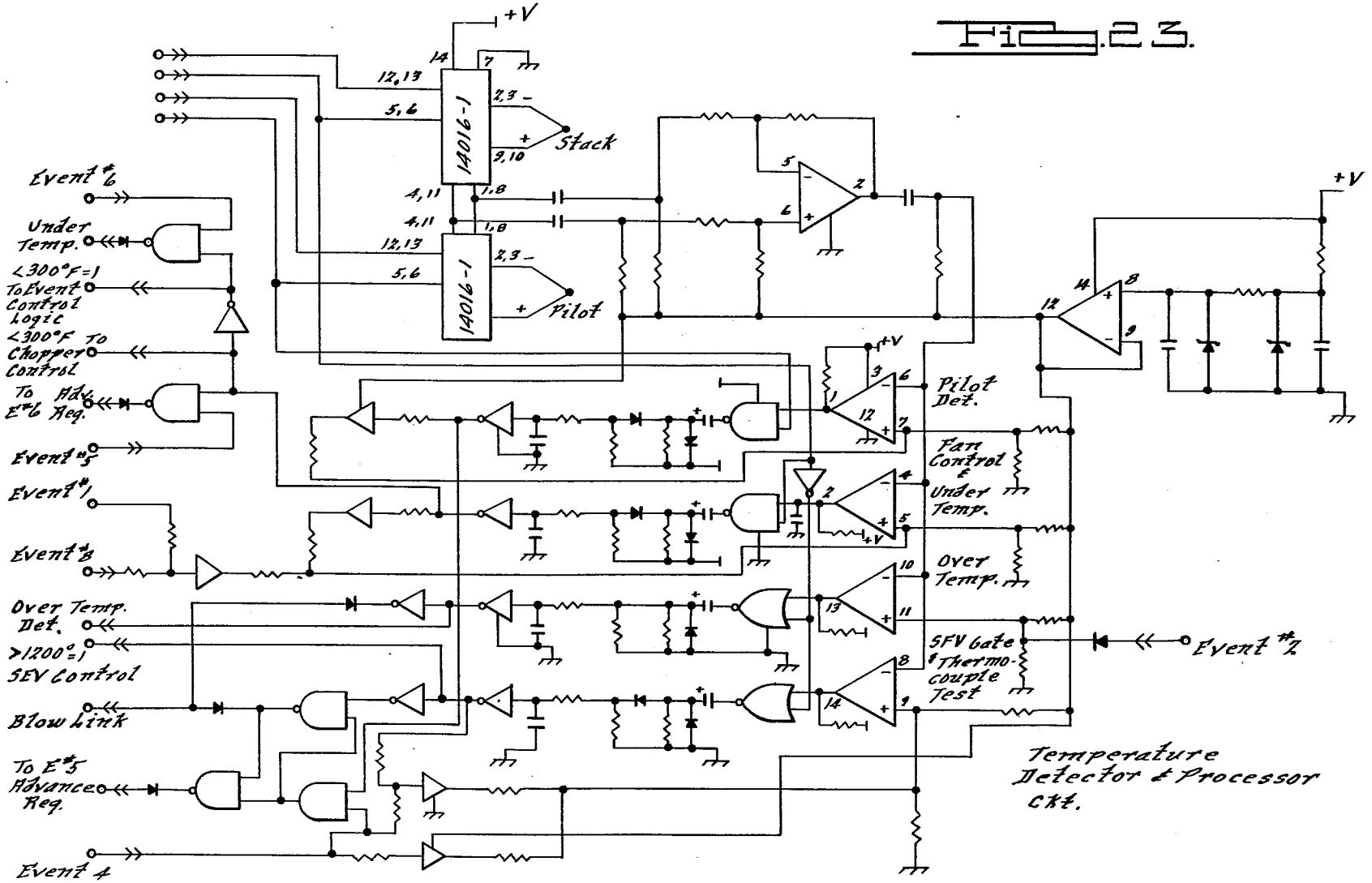
Figure 24:
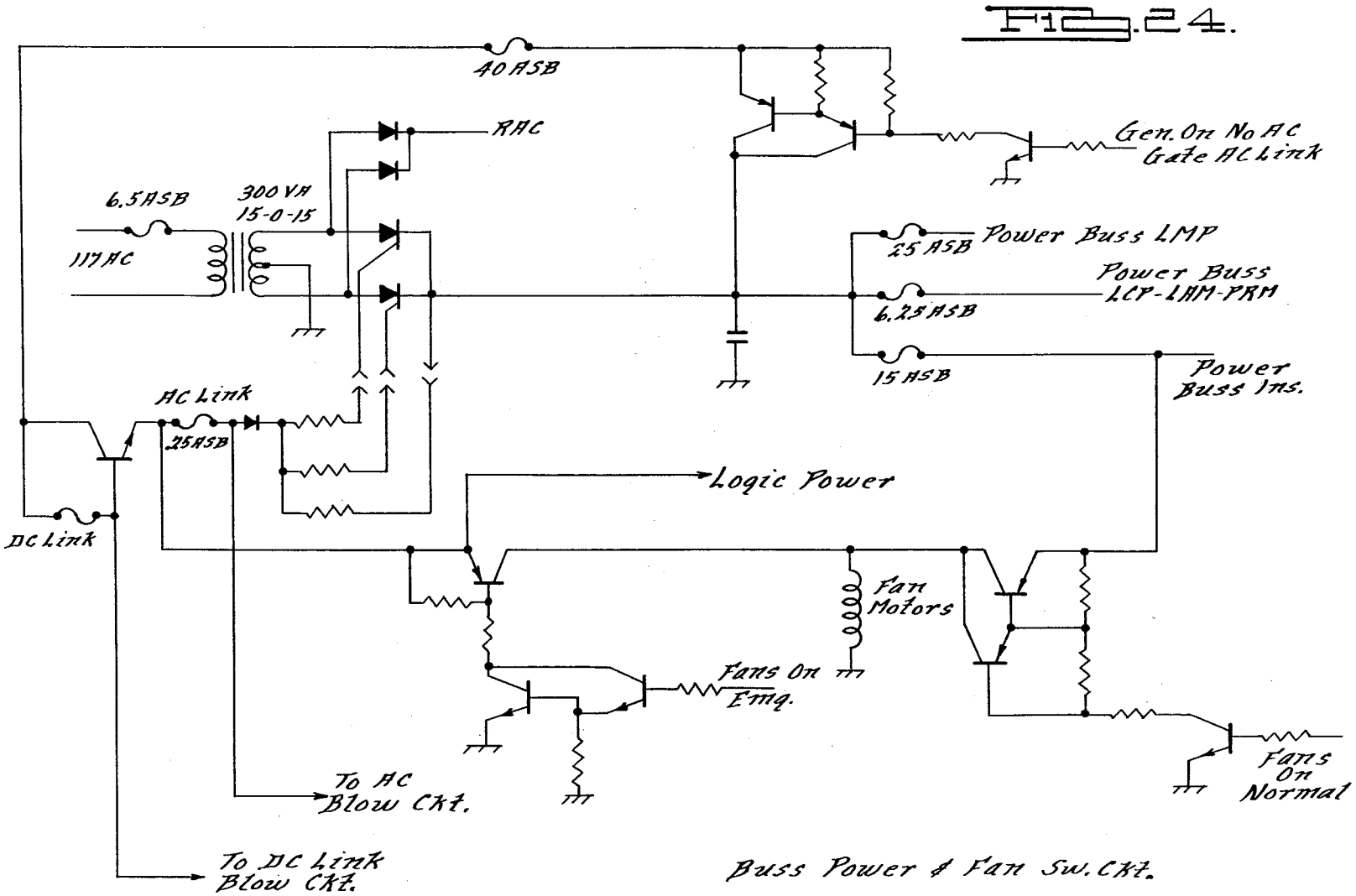
Figure 25:
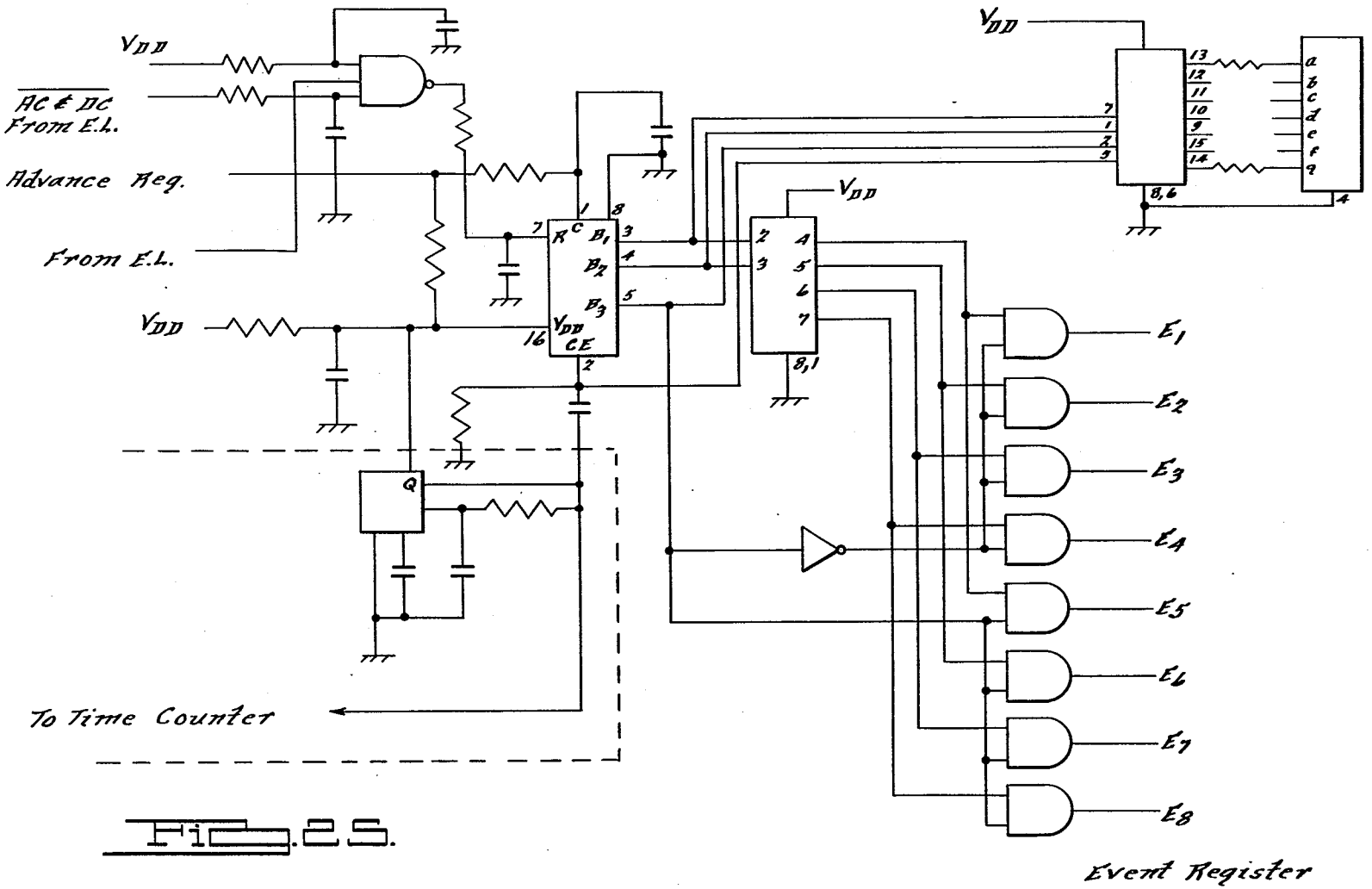

Referring to FIG. 9, a block diagram of the electronic control circuit 18 is shown. The control circuit itself is operated under the d.c. power from the battery of the marine craft or other vehicle on which the disposal system is located. The mechanical components of the system however are preferably operated under alternative power sources, either rectified a.c. or the output from an alternator or d.c. generator, if available. As an initial precaution, the control unit 18 is adapted to determine whether adequate power is present. If adequate power is not present, the system will remain inoperative. In addition, if at any time during the system's operation, all non-battery power is lost, the control unit 18 will automatically deactivate the entire system, except for the fans, which will continue to be operated under battery power until the entire unit has cooled below 300° F. This function is provided by a buss power select circuit 150 which essentially determines whether or not rectified a.c. power or auxiliary d.c. power from an alternator or generator is present. If the power select circuit 150 is satisfied that adequate power is available, an enable signal is provided on line 152 to the event register 154 and the timing circuit 156. The enable signal permits the system to shift out of the standby mode, or event zero. In addition, the buss power select circuit 150 routes power to the power switching circuit 158. The power switching circuit 158 comprises a plurality of relatively high current switching transistors and associated circuitry that are adapted, when appropriately enabled by control signals from the logic control center 160, to direct current to the various mechanical components individually controlled.

The heart of the electronic control unit 18 is the logic control center 160. The control center 160 essentially comprises a plurality of logic circuits that provide instructional signals to the power switching circuit 158 and failsafe circuit 162 pursuant to analytical decisions that are made in accordance with information provided to the logic center 160. In particular, the logic control center 160 receives input primarily from three sources; the event register 154, the temperature detector circuit 162, and the timing circuit 156. The event register 154 is adapted to keep track of the current "location" of the system and provide a signal to the logic control center 160 identifying the event in which the system is currently operating. When all of the required operations for that event have been performed, the logic control center 160 provides an advance signal incrementing the event register 154 to the next event. The timing circuit 156 is adapted to provide various incremental timing signals to the logic control center 160 which the control center utilizes to determine whether or not certain time periods have expired. Specifically, the timing circuit 156 provides one second, one minute, two minutes, four minutes, eight minutes, and sixteen minutes signals which the logic control center 160 uses to calculate all of the required time intervals encountered during the operation of the system. The control center 160 is further adapted to control the initiation of the timing circuit 156 so that the various timers can be reset when desired to measure the appropriate time periods.

The logic control center 160 receives temperature input from the temperature detector circuit 162. The temperature detector 162 in turn receives information from the temperature amplifier and processor circuit 164. The temperature amplifier and processor circuit 164 is adapted to convert the electrical signals received from the exhaust stack and pilot thermocouples 166 and 168 respectively, to analog signals that are proportional to the temperature readings taken. The analog signals from the temperature processor 164 are then provided to the temperature detector circuit 162 which compares the temperature readings of the thermocouples to various predetermined temperature values and informs the logic control center 160 of the results of the comparisons. In particular, the logic control center 160 may, for example, "ask" the temperature detector circuit 162 whether or not the stack temperature is above 1000° F. The temperature detector circuit 162 will respond by providing a logic signal to the logic control center 160 indicating either a "yes" or "no" answer.

Finally, the failsafe circuit 162 is provided which is adapted to monitor and confirm the occurence of certain critical operations of the system. For example, if the logic control center 160 directs that the macerator pump is to be activated, the failsafe circuit 162 determines if in fact power has been applied, and whether or not the component is properly connected. The failsafe circuit 162 accomplishes this by checking the impedance characteristic of the line. If a high impedance is present, indicating the lack of a proper ground, the failsafe circuit 162 directs the buss power select circuit 150 to blow the links. The buss power select circuit 150 will, in turn, reset the event register 154 to event zero by removing the enable signal, and the system will reenter the standby mode. Similarly, if, for example, either of the fan pressure switches do not close after the logic control center 160 has instructed that the fans be activated, the failsafe circuit 162 will instruct the buss power select circuit 150 to blow the links and apply battery power to the fans. It is to be understood, that under all failsafe conditions, the control circuit 18 is adapted to continue to operate the fans, under d.c. battery power if necessary, until the system has cooled below 300° F. before the entire system is deactivated and the trouble light illuminated. In addition, latent heat in the system causes the temperature to rise above 400° F., the fans will automatically be reactivated and operated until the temperature of the system again.

Referring to FIGS. 10–17, the overall sequential operation of the system will now be explained. In the standby mode, or Event zero, the event register is set to zero. The output from the event register is provided to an LED display which appears on the front panel of the incinerator unit 16 to provide a visual indication of the event in which the system is currently operating. While in the standby mode, the control circuit 18 continuously monitors the exhaust stack temperature of the incineration unit 16 to insure that it is below 400° F. If, for example, residual heat from the previous operation of the system causes the temperature of the unit to increase above 400° F., the control circuit 18 will first check for a source of available power and then automatically activate the cooling and combustion fans until the stack temperature falls below 300° F.

It is to be noted at this point that there is disposed at the discharge nozzle of both fans, an air switch that is adapted to close when air is being discharged from the fan and open when the fan is off. Thus, throughout the operation of the system, whenever the control circuit 18 has instructed that the fans be either activated or deactivated, the conditions of the air switches are always checked to confirm the status of the fans.

Once the control circuit 18 is satisfied that the temperature of the exhaust stack is at a safe level, the availability of adequate power is confirmed and the standby light located on the front panel of the incinerator unit 16 is turned on. If adequate power is not present, the system will not shift out of the standby mode. During the standby mode, the control circuit 18 checks the liquid level sensing switch located in the holding tank of the maceration unit 14 to determine if the switch has been closed for the previous two minute period. The system will remain in the standby mode, also continuously monitoring the exhaust stack temperature, until the holding tank of the maceration unit 14 is filled to the appropriate level. The two minute closure requirement is included to insure that the liquid level switch has not closed merely because of the excrement "sloshing" within the holding tank caused by the rocking of the vessel or vehicle.

When the control circuit 18 senses that the liquid level switch has been closed for two minutes, it again checks to insure that adequate power is available before shifting out of the standby mode. If power is not available at this point, a warning light on the front of the incinerator unit 16 is turned on. As an additional precaution, the control circuit 18 also confirms the two minute period by checking a backup time T2 before proceeding to Event 1.

Event 1 consists essentially of activating the combustion and cooling fans and checking for positive thermocouple sensing. Only when the fans have been confirmed turned on and the thermocouples proven good will the control circuit 18 advance to Event 2. During Event 1, the control circuit 18 loads into a pair of registers the pre-established over-temperature and under-temperature values, to be subsequently described, and checks to insure that the ignition timer is set to zero. To confirm positive thermocouple sensing, the control circuit 18 compares the current reading of the exhaust stack thermocouple with the newly loaded over-temperature and under-temperature values. Since the incineration cycle has not yet begun, the thermocouple reading should be less than both the over-temperature and under-temperature values. If these conditions are satisfied, the control circuit 18 supplies power to the cooling and combustion fans and confirms activation of the fans by checking the condition of the air switches. Upon confirmation, the standby light is extinguished and the control circuit 18 proceeds to Event 2.

Event 2 essentially comprises a 60-second purge cycle which is included to remove, prior to incineration, any residual fumes which may have accumulated in the incineration unit 16. While the fans are operating, the control circuit 18 activates the liquid circulation pump on the maceration unit and starts the agitator motor located in the holding tank. The control circuit 18 then waits 60-seconds and proceeds to Event 3.

Event 3 begins the ignition cycle. Power is applied to the glow plug, or ignitor, and the fans are reduced to half speed to decrease the cooling rate of the incinerator unit 16 and allow a heat buildup for the start of ignition. The control circuit 18 then initiates the ignition and backup timers, and waits 30 seconds to permit the glow plug to heat up. Once this preheat cycle is completed, power is applied to the fuel pump and to the primary fuel valve. A load check is then performed to confirm both operations. It will be recalled, that the primary fuel valve provides approximately one half the total fuel flow capacity to the burner.

The control circuit 18 confirms ignition by checking the pilot thermocouple to determine whether the temperature at the burner has reached 400° F. If the temperature of the burner does not reach 400° F. within 3 minutes from the time fuel is initially supplied, the emergency shutdown routine is initiated. If the 400° temperature is attained within the allotted time, the control circuit 18 additionally checks the exhaust stack thermocouple to determine if the temperature of the exhaust has reached 150° F. If this condition is not also satisfied, the emergency shutdown routine is entered. Upon confirmation of burner ignition, the system proceeds to Event 4.

During Event 4, the combustion chamber is brought up to operating temperature. The secondary fuel valve is opened to provide maximum fuel flow to the burner, the glow plug is turned off, and full power is reapplied to the fans. The system is then given 45 minutes to reach an operating temperature of 1100° F., as measured by the exhaust stack thermocouple. If the proper operating temperature is not attained within the 45 minute period, the emergency shutdown routine is entered. Otherwise, the system proceeds to Event 5.

Once operating temperature has been attained, the incineration cycle is initiated. The effluent feed pump on the incineration unit 16 is activated and a 16 minute incineration timer is initiated. To confirm that effluent is being fed into the combustion chamber, the control circuit 18 checks the condition of a feed pressure switch disposed in the feed line between the feed pump and the combustion chamber. The feed pressure switch is adapted to detect the flow of effluent through the feed line by sensing the pressure differential in the line. However, other types of sensors can be employed. At this point, the liquid circulation pump of the macerator unit 14 should have had sufficient time to pump effluent through the circulation line to the incinerator unit 16. However, a three minute leeway is provided within which the feeding of effluent into the combustion chamber must begin before the emergency shutdown routine is entered. If the feed pressure switch is closed within the three minute period, the system proceeds to Event 5.

It should be noted that the check of the feed pressure switch serves several important additional functions. By indicating that effluent is properly being fed into the combustion chamber, the feed pressure switch also confirms the absence of leaks or breaks in the circulation and feed lines, the proper functioning of the liquid circulation pump, and the proper functioning of the macerator which liquifies the excrement and fills the feed compartment permitting the effluent to be pumped through the feed lines. Accordingly, if the feed pressure switch does not close within the allotted three minute period, any of the above factors could be the cause of the manfunction.

Once the incineration cycle, Event 5, is initiated, the control circuit 18 is adapted to continuously monitor the exhaust stack temperature to insure that it never falls below the under-temperature setting of 900° F., or increases above the over-temperature setting of 1325° F. The under-temperature value of 900° F. represents the minimum temperature at which no odor is produced by the burning process. The over-temperature value of 1325° F. is selected merely as a safety factor. If the exhaust stack temperature ever falls outside of these limits, the system will automatically enter the emergency shutdown routine and blow the links.

During the incineration cycle it is desirable to maintain the exhaust stack temperature between 1000° F. and 1200° F. In order to maintain the exhaust stack temperature within these limits, the secondary fuel valve is cycled between its opened and closed positions in accordance with variations in the stack temperature. Specifically, when the exhaust stack temperature falls below 1000° F., the secondary fuel valve is opened and when the exhaust stack temperature increases above 1200° F., the secondary fuel valve is closed.

The incineration cycle comprises two sixteen minute phases. During the first, or feed phase, effluent is fed into the combustion chamber of the incineration unit 16. During the second, or burn-out phase, the effluent feed pump is turned off and the effluent within the combustion chamber is completely incinerated. For the first 14-minutes of the feed phase of the incineration cycle, the logic circuit 18 continuously monitors the condition of the feed pressure switch to insure that the feed pump is operating properly. If at any time the feed pressure switch opens, the emergency shutdown routine is entered. Fourteen minutes into the feed phase of the incineration cycle, the macerator pump and motor and the pot rotator motor are activated. The macerator and pot rotator motor remain on for the remaining two minutes of the 16 minute feed phase. The macerator is operated at this point of the cycle primarily due to the power requirements of the pump and motor. Specifically, the current draw of the macerator is such that it can only be operated for relatively short periods of time. In addition, since the macerator can macerate substantially more waste in two minutes than the incinerator can dispose of during the entire incineration cycle, there is always an adequate amount of effluent in the feed tank of the maceration unit to supply the incinerator. Thus, the precise time during the operation of the system that the macerator is activated is variable. Accordingly, other factors such as the power requirements of the system and design convenience can be considered. Note also, that the crucible within the combustion chamber does not rotate at this time, although the pot rotator motor is turned on, because the clutch is not engaged. The only reason for activating the pot rotator motor at this time is that design considerations make it convenient to connect the pot rotator motor and macerator in parallel so that both units are operated simultaneously.

Upon completion of the 16 minute feed phase of the incineration cycle, the timer is reset to zero and the system enters the 16 minute burn-out phase of the cycle. In particular, a timer flag is switched from a LO logic state to a HI logic state indicating the completion of the first 16 minutes of the cycle, and the beginning of the burn-out phase. After the timer flag is switched, the feed pump is turned off and the feed pressure switch checked to confirm deactivation of the pump. The feed pressure switch is given three minutes in which to open. If the switch does not open within this time, the emergency shutdown routine is entered.

During the burn-out phase of the incineration cycle, the control circuit 18 continues to monitor the exhaust stack temperature and cycle the secondary fuel valve to maintain the stack temperature between 1000° F., and 1200° F. However, since the effluent is no longer being fed into the combustion chamber the temperature at the exhaust stack will begin to rise with the secondary fuel valve open. Accordingly, approximately 7 minutes into the burn-out phase of the cycle, the secondary fuel valve will have to remain closed for substantially the balance of the cycle in order to maintain the stack temperature below 1200° F. With the secondary fuel valve closed for a greater percentage of the time, the increased air-to-fuel ratio in the combustion chamber causes the remaining waste material in the crucible to be burned to a fine ash. This secondary burning of the waste material is an important feature of the system because it results in the complete oxidation of the effluent. In this manner, the waste material is prevented from caking inside the crucible over numerous operations of the system. In addition, complete oxidation of the effluent insures that no odors will be exhausted when the unit begins operation after a shutdown period, or during its current shutdown period.

Fourteen minutes into the burn-out phase of the incineration cycle, the macerator pump and motor and pot rotator motor are again turned on for two minutes. Fifteen minutes into the burn-out phase, or one minute after the pot rotator motor is started, power is momentarily applied to the electric clutch, thereby causing the crucible inside the combustion chamber to slowly rotate one complete revolution. The microswitch mounted adjacent the shaft of the motor is then checked to insure that the pot is stopped in the upright position. If the pot is not upright at the end of the incineration cycle the emergency shutdown routine is entered.

Upon completion of the incineration cycle, the control circuit 18 again checks the liquid level switch in the holding tank of the maceration unit to determine whether the switch has been open for the previous two minute period. If the liquid level switch is still closed, the system enters a new incineration cycle and the feed pump is once again turned on. However, if the liquid level switch has been open for the previous two minutes, the system advances to Event 6.

Event 6 begins the shutdown and secure sequence. The macerator pump and motor, pot rotator motor, liquid circulation pump, and agitator motor are all turned off. Additionally, if the feed pump is not already off, it also is deactivated and the feed pressure switch checked to confirm the absence of effluent flow. The secondary and primary fuel valves are then closed and the fuel pump deactivated. After a delay of five seconds, the liquid circulation pump is activated in the *reverse* direction to clear the circulation line of effluent. This feature is particularly important to the proper operation of the system since the feed lines will eventually become clogged if effluent is permitted to remain stagnant in the feed lines after the system is shut down. The liquid circulation pump is operated in the reverse direction for three minutes, after which time the system advances to Event 7, wherein the liquid circulation pump is turned off and the cooldown period is initiated. During Event 7, both the combustion and cooling fans remain on at full power for a 30 minute period. If after 30 minutes the exhaust stack temperature has not fallen below 300° F., the fans will continue to operate. When the exhaust stack temperature cools to 300° F., the fans are turned off and the fan switches checked to confirm deactivation of the fans. The system then returns to the standby mode.

Whenever a condition arises which causes the control circuit 18 to enter the emergency shutdown sequence, the circuit initially waits for a 15 second period to allow the condition which caused entry into the emergency shutdown sequence to correct itself. If the condition continues to persist after 15 seconds, the trouble light is turned on and the a.c. links are blown. Both the combustion and cooling fans are then operated under battery power for a 30 minute period to insure that the system is cooled before the control circuit 18 automatically shuts down the entire system.

While the above description constitutes the preferred embodiment of the invention, it will be appreciated that the invention is susceptible to modification, variation and change without departing from the proper scope or fair meaning of the accompanying claims.

What is claimed is:

1. In a waste disposal system for disposing of excrement including an incinerator having a burner and a first fuel valve for supplying a minimum amount of fuel to said burner and a second fuel valve for supplying an additional amount of fuel to said burner, the method of disposing of excrement including the steps of:

converting the excrement to a substantially liquified effluent;

igniting said burner;

feeding effluent into said incinerator;

regulating said second fuel valve in response to the exhaust gas temperature to boil away the liquid in said effluent at a first average fuel-to-air mixture;

terminating the feeding of effluent into the incinerator;

and regulating said second fuel valve in response to the exhaust gas temperature after said liquid has been boiled away to incinerate the remaining waste material at a second lower average fuel-to-air mixture.

2. The method of claim 1 wherein said excrement is converted to a substantially liquified effluent by macerating said excrement.

3. The method of claim 1 wherein said effluent is incinerated in a crucible disposed within said incinerator, and further including the step of dumping said crucible of said ash after said incineration process.

4. The method of claim 1 wherein said second fuel valve is regulated so that said incineration process is conducted at temperatures that will maintain the temperature of said exhaust gases above a predetermined minimum level.

5. The method of claim 4 wherein said predetermined minimum level is 900° F.

6. The method of claim 1 wherein said second fuel valve is regulated so that said incineration process is conducted at temperatures that will maintain the temperature of said exhaust gases within a predetermined temperature range.

7. The method of claim 6 wherein said temperature range is between 900° F. and 1325° F.

8. The method of claim 6 wherein said incineration process is conducted for a predetermined period of time.

9. The method of claim 8 wherein the feeding of effluent into said incinerator continues during said incineration process for a predetermined portion of said predetermined period of time.

10. The method of claim 9 wherein said predetermined portion is approximately half of said total predetermined period of time.

11. The method of claim 1 further including the step of bringing the temperature of said incinerator up to a preselected temperature prior to the feeding of effluent into said incinerator.

* * * * *